US007093952B2

(12) United States Patent
Ono et al.

(10) Patent No.: US 7,093,952 B2
(45) Date of Patent: Aug. 22, 2006

(54) LIGHTING APPARATUS

(75) Inventors: Masato Ono, Anan (JP); Kazunori Watanabe, Anan (JP); Masaru Kato, Anan (JP)

(73) Assignee: Nichia Corporation, Tokushima (JP)

( * ) Notice: Subject to any disclaimer, the term of this patent is extended or adjusted under 35 U.S.C. 154(b) by 0 days.

(21) Appl. No.: 11/260,142

(22) Filed: Oct. 28, 2005

(65) Prior Publication Data

US 2006/0044804 A1 Mar. 2, 2006

Related U.S. Application Data

(62) Division of application No. 10/419,936, filed on Apr. 22, 2003, now Pat. No. 7,011,431.

(30) Foreign Application Priority Data

| | | | |
|---|---|---|---|
| Apr. 23, 2002 | (JP) | ..... | P 2002-120461 |
| Sep. 10, 2002 | (JP) | ..... | P 2002-264217 |
| Oct. 2, 2002 | (JP) | ..... | P 2002-290226 |

(51) Int. Cl.
*F21V 29/00* (2006.01)
*F21V 19/02* (2006.01)

(52) U.S. Cl. ..... 362/194; 362/285

(58) Field of Classification Search ..... 362/294, 362/580, 547, 126, 218, 264, 345, 373, 269, 362/285, 287, 418, 421, 427, 449, 433, 523
See application file for complete search history.

(56) References Cited

U.S. PATENT DOCUMENTS

| | | | | |
|---|---|---|---|---|
| 4,646,214 | A * | 2/1987 | Mendleski | 362/294 |
| 4,760,509 | A * | 7/1988 | Panagiotou | 362/285 |
| 4,841,422 | A * | 6/1989 | Groh | 362/294 |
| 5,857,767 | A * | 1/1999 | Hochstein | 362/294 |
| 6,578,998 | B1 | 6/2003 | Zhang | 362/555 |
| 6,641,284 | B1 | 11/2003 | Stopa et al. | 362/240 |
| 2002/0191396 | A1 | 12/2002 | Reiff et al. | 362/240 |

* cited by examiner

*Primary Examiner*—Sandra O'Shea
*Assistant Examiner*—Bao Q Truong
(74) *Attorney, Agent, or Firm*—Wenderoth, Lind & Ponack, L.L.P.

(57) ABSTRACT

To provide a lighting apparatus that includes a simple and small moving mechanism capable of changing the light emanation direction and that has superior heat dissipation properties, the lighting apparatus includes a light-emitting unit, and a heat dissipation unit for dissipating heat generated by the light-emitting unit during light emission, wherein a heat transfer unit is connected between the light-emitting unit and the heat dissipation unit, and the light-emitting unit is in surface contact with the heat transfer unit and is connected with the heat transfer unit to be rotatable with one point or one line in the center.

19 Claims, 16 Drawing Sheets

LIGHTING APPARATUS

This application is a divisional application of application Ser. No. 10/419,936, filed Apr. 22, 2003, now U.S. Pat. No. 7,011,431, issued Mar. 14, 2006.

BACKGROUND OF THE INVENTION

1. Field of the Invention

The present invention relates to a lighting apparatus; more specifically, it relates to a lighting apparatus including a relatively small light-emitting unit formed using a light-emitting diode.

2. Description of Related Art

In a conventional lighting apparatus including a heat dissipation section such as a heat sink, a light-emitting section is directly mounted in the heat dissipation section to dissipate heat generated by the light-emitting section.

However, problems arise from the conventional lighting apparatus that includes the light-emitting section directly mounted in the heat dissipation section. When changing the light emanation direction, the overall lighting apparatus including the heat dissipation section needs to be moved. As such, a large moving mechanism needs to be provided in the apparatus, and the structure of the apparatus is complicated.

SUMMARY OF THE INVENTION

In view of the problems described above, an object of the present invention is to provide a lighting apparatus that includes a simple and small moving mechanism capable of changing the light emanation direction and that has superior heat dissipation properties.

Another object of the present invention is to provide a small-sized lighting apparatus capable of emitting light with high power and that has superior heat dissipation properties.

In order to achieve the above object, a lighting apparatus according to a first aspect of the invention includes a light-emitting unit, and a heat dissipation unit for dissipating heat generated by the light-emitting unit during light emission, wherein a heat transfer unit is connected between the light-emitting unit and the heat dissipation unit, and the light-emitting unit is in surface contact with the heat transfer unit and is connected with the heat transfer unit to be rotatable with one point or one line in the center.

In the thus-constructed lighting apparatus according to the first aspect of the invention, only the light-emitting unit can be rotated with one point or one line in the center independently of the heat dissipation unit (for example, in a state where the heat dissipation unit is immobilized). As such, the light emanation direction can be changed by using a simple and small moving mechanism.

In addition, since the light-emitting unit is provided in surface contact with the heat dissipation unit, the lighting apparatus can be constructed to exhibit high heat dissipation properties.

A lighting apparatus according to a second aspect of the invention includes a light-emitting unit, and a heat dissipation unit for dissipating heat generated by the light-emitting unit during light emission, wherein a heat transfer unit is connected between the light-emitting unit and the heat dissipation unit, and the heat dissipation unit is in surface contact with the heat transfer unit and is connected with the heat transfer unit to be rotatable with one point or one line in the center.

In the thus-constructed lighting apparatus according to the second aspect of the invention, similar to the case of the lighting apparatus according to the first aspect, only the light-emitting unit can be rotated about one point or one line as the center independently of the heat dissipation unit. As such, the light emanation direction can be changed by using a simple and small moving mechanism, and in addition, the lighting apparatus can be constructed to exhibit high heat dissipation properties.

The lighting apparatus according to each of the first and second aspects of the invention may be arranged such that a spherical end portion is provided at one end of the heat transfer unit; and a spherical-surface receiving section including a spherical surface is provided in the light-emitting unit or the heat dissipation unit, and is connected to the heat transfer unit so that a surface of the spherical end portion is in surface contact with a surface of the spherical-surface receiving section. Thereby, the light-emitting unit or the heat dissipation unit can be connected to the heat transfer unit to be rotatable with about a center point.

Further, the lighting apparatus according to each of the first and second aspects of the invention may be arranged such that a portion of the heat transfer unit is used as a circular-cylindrical connection portion; and a receiving section including a circumferential surface is provided in the light-emitting unit or the heat dissipation unit, and is connected to the heat transfer unit so that a surface of the connection portion is in surface contact with the circumferential surface of the receiving section. Thereby, the light-emitting unit or the heat dissipation unit can be connected to the heat transfer unit to be rotatable about a center line.

Further, the lighting apparatus according to each of the first and second aspects of the invention may be arranged such that a portion of an outer periphery the heat transfer unit is formed in an arcuate shape; and an inner-periphery receiving surface with which the outer periphery having the arcuate shape is engaged is provided in the light-emitting unit or the heat dissipation unit, and the light-emitting unit or the heat dissipation unit is connected to the heat transfer so that the outer periphery having the arcuate shape and the inner-periphery receiving surface are engaged with one another. Thereby, the light-emitting unit or the heat dissipation unit can be connected to the heat transfer unit to be rotatable about a center point.

In the lighting apparatus according to both of the first and second aspects of the invention, the light-emitting unit may include at least one light-emitting diode.

In the lighting apparatuses according to both of the first and second aspects of the invention, the heat dissipation unit may preferably have a heat dissipation layer including ceramics for irradiating far-infrared rays onto the surface thereof.

A third lighting apparatus according to the invention is a lighting apparatus including a light-emitting unit, and a heat dissipation unit for dissipating heat that is generated during light emission, wherein the heat dissipation unit has a heat dissipation layer including ceramics for irradiating far-infrared rays onto the surface thereof.

By coating ceramics irradiating far-infrared rays or a layer comprising such ceramics onto the heat dissipation unit, it is possible to further improve heat dissipation properties of the heat dissipation unit.

Furthermore, in the lighting apparatuses according to each of the first to third aspects of the invention, the heat-transfer unit may preferably be formed by a heat pipe.

For solving the above subjects, a lighting apparatus according to the fourth aspect of the invention is a lighting apparatus including a light-emitting unit, a reflection unit having a reflection surface for reflecting and dispersing emanated light from the light-emitting unit, and a heat dissipation unit for dissipating heat generated by the light-emitting unit, wherein the reflection surface is formed by a reflection layer containing ceramics for irradiating far-infrared rays.

Since the lighting apparatus according to the fourth aspect of the invention is arranged in that the reflection surface of the reflection unit is provided with a reflection layer containing ceramics for irradiating far-infrared rays, the reflection layer may dissipate transferred heat of the light-emitting unit as far-infrared rays so as to suppress increases in the temperature of the light source. With this arrangement, a conventional reflection unit may act as a heat dissipation body, and it is accordingly possible to reduce the surface area of the heat dissipation unit when compared to an arrangement in which heat dissipation is performed through the heat dissipation unit alone and thus to achieve downsizing of the lighting apparatus.

The lighting apparatus according to the fourth aspect of the invention also exhibits insect repelling effects in which attraction of insects is being prevented during light emission. Since the lighting apparatus and its periphery will not become dirty through attracted insects, it is not necessary to frequently perform cleaning and is thus hygienic. Methods have been conventionally employed for repelling insects in lighting apparatuses in which insecticide chemicals were applied onto surfaces of lighting apparatuses or in which filters were employed for preventing light of mainly the ultraviolet region, which attracts insects, from leaking outside. However, the lighting apparatus of the invention does not require any insecticide chemicals and is thus safe to the human body, and since it does not require any additional members such as filters, it is possible to achieve downsizing of the apparatus and thus to improve the degree of freedom of configuration. While reasons thereof are not necessarily apparent, it is deemed that far-infrared rays that are irradiated from the ceramics exhibit insect repelling effects.

In the lighting apparatus according to the fourth aspect of the invention, the reflection unit may concurrently serve as the heat dissipation unit. With this arrangement, it is possible to omit the heat dissipation unit so that the lighting apparatus may be further downsized.

In the lighting apparatus according to the fourth aspect of the invention, it is possible to employ ceramics for irradiating far-infrared rays containing therein one or more oxides selected from a group at least consisting of $Al_2O_3$, $SiO_2$, $SnO_2$, MgO, CaO, $ZrO_2$, $TiO_2$ and $Li_2O$. Preferably, ceramics containing one type selected from a group consisting of $Al_2O_3$—$SiO_2$, $ZrO_2$—$SiO_2$, $TiO_2$—$Al_2O_3$, $Al_2O_3$—$SiO_2$—$TiO_2$, $Al_2O_3$—$SiO_2$—$SnO_2$ may be employed.

The lighting apparatus according to the fourth aspect of the invention may be provided with a heat transfer unit for transferring heat that has been generated by the light-emitting unit to the reflection unit. As the heat transfer unit, it is possible to use a heat pipe or a heat plate.

A lighting apparatus of pendant type according to a fifth aspect of the invention comprises a light-emitting unit provided with a plurality of light-emitting diodes aligned in a linear manner, a reflection unit having a reflection surface that is formed by a reflection layer containing therein ceramics that irradiate far-infrared light and concurrently serving as a cover of the light-emitting unit, and a heat transfer unit, which is a ring-like heat pipe that is supported by the reflection unit for transferring heat that is generated by the light-emitting unit to the reflection unit and which concurrently serves as a suspending member for suspending the light-emitting unit, wherein irradiated light from the light-emitting unit is reflected by the reflection surface of the reflection unit to be irradiated to downward of the light-emitting unit.

For solving the above objects, the lighting apparatus according to a sixth aspect of the invention is a lighting apparatus comprising a light source and a reflection unit that opposes the light source and that has a reflection surface for reflecting irradiated light, wherein the apparatus further includes a heat transfer unit that is connected to the light source and wherein the light source is mounted to the heat transfer unit either directly or through a beat conducting base.

By mounting the light source either directly to the heat transfer unit or via a heat conductive base of favorable heat conductivity, heat generated at the light source during light emission is rapidly transferred to the heat transfer unit, and it is possible to effectively suppress increases in the temperature of the light source. With this arrangement, a lighting apparatus of favorable dissipating properties and capable of performing high-output irradiation may be provided.

When there are a plurality of light sources, it is preferable that heights for disposing adjoining light sources are different, and that the adjoining light sources are arranged in that an inclined surface is provided between one light source that is disposed at a lower position and another light source that is disposed at a higher position for reflecting light that has been emitted from the one light source towards the other light source in a direction of the reflection surface.

In the light-emitting apparatus according to the invention, when the lighting apparatus further includes a heat dissipation unit, one end portion of the heat transfer unit may preferably be connected to the heat dissipation unit.

When the lighting apparatus is provided with a mounting terminal for mounting the same to a mounting surface, it is preferable that the heat transfer unit is arranged in that the end portion of the heat transfer unit contacts the mounting surface when the lighting apparatus is in a mounted condition.

By employing such an arrangement, heat dissipation may be directly performed from the light source to the heat dissipation unit or the mounting surface via the heat transfer unit so that the heat dissipation properties of the lighting apparatus may be further improved.

It is further possible to provide a conductive substrate for supplying electric power to the light source along the heat transfer unit in the lighting apparatus according to the invention.

By employing such an arrangement, it is possible to prevent cases in which irradiated light is shielded by wiring cords or similar for supplying electric power to the light source.

A lighting apparatus according to a seventh aspect of the invention is a lighting apparatus comprising a light-emitting unit and a heat dissipation unit for dissipating heat that is generated during light emission, wherein a heat transfer unit is connected between the light-emitting unit and the heat dissipation unit, and wherein the light-emitting unit is in contact with the heat transfer unit either directly or via a heat conductive base.

In the lighting apparatus according to the seventh aspect, the heat dissipation unit may preferably be provided with a heat dissipation layer including ceramics for irradiating far-infrared rays onto its surface.

DESCRIPTION OF THE PREFERRED EMBODIMENTS

Hereinbelow, lighting apparatuses of embodiments according to the present invention will be described with reference to the accompanying drawings.

First Embodiment

Figure 1A:
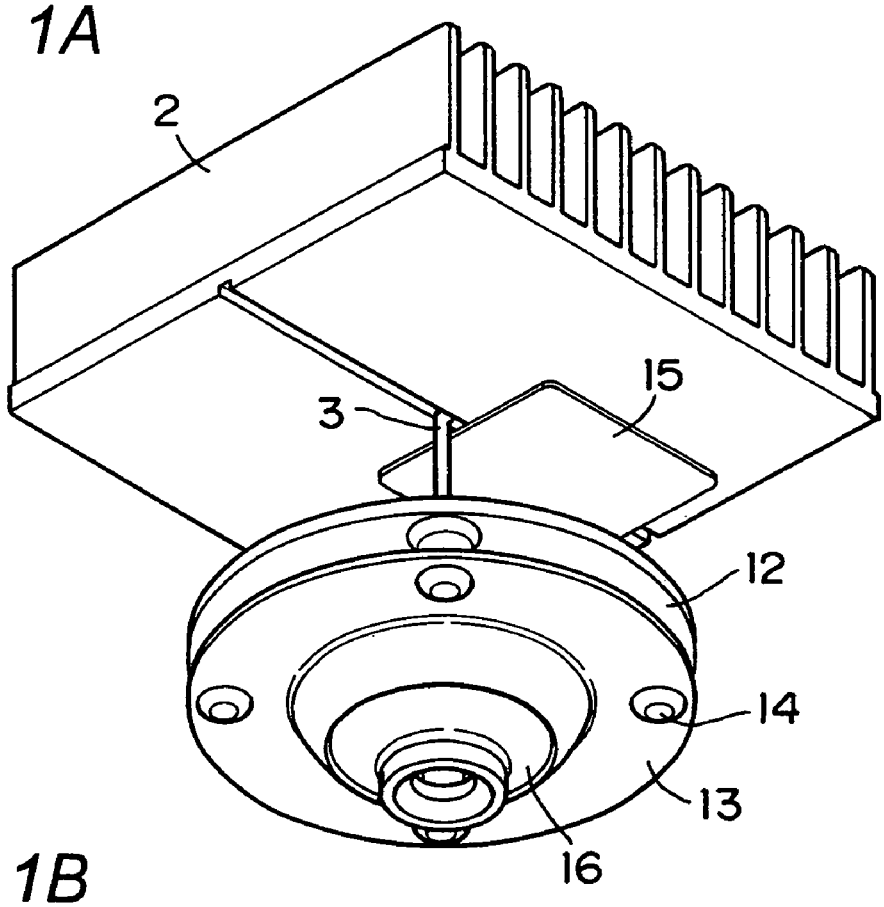
FIG. 1A is an overall perspective view of a lighting apparatus according to a first embodiment of the present invention.
Figure 1B:
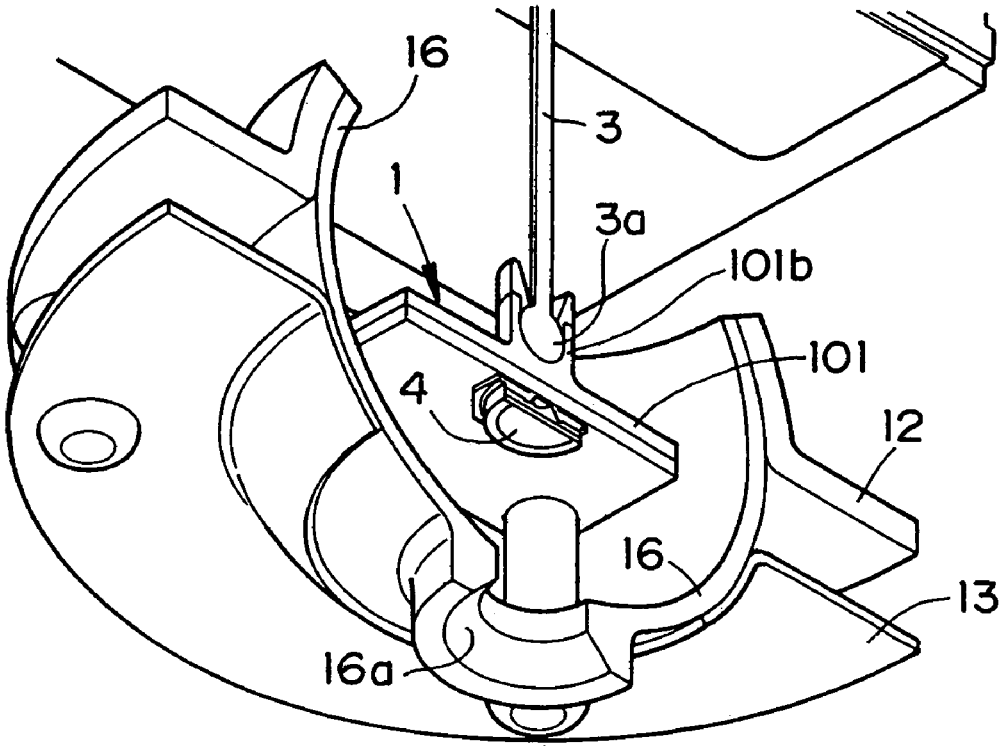
FIG. 1B is a partial cross-sectional perspective view showing the construction of a light-emitting unit of the lighting apparatus.

As shown in FIGS. 1A and 1B, a lighting apparatus of a present first embodiment is constructed such that a light-emitting unit 1 and a heat dissipation unit 2 are connected to one another via a heat transfer unit 3 (heat pipe).

In the lighting apparatus of the present first embodiment, the heat transfer unit 3 is formed by the heat pipe, and a spherical end portion 3*a* is formed at one end portion of the heat transfer unit 3.

The light-emitting unit 1 has a construction including a base 101 and a light-emitting diode 4 mounted thereon. On the back face of the base 101, a spherical-end receiving section 101*b* into which a spherical end portion 3*a* of the heat transfer unit 3 is fitted is formed. The spherical end portion 3*a* is fitted into the spherical-end receiving section 101*b* to be slidably movable in a state where the spherical end portion 3*a* is kept in contact with the surface of the base 101. In this manner, the heat transfer unit 3 and the light-emitting unit 1 are connected to one another.

As described above, in the lighting apparatus of the present first embodiment, the light-emitting unit 1 is connected to the heat transfer unit 3 to be rotatable with the center of the spherical end portion 3*a* in the center.

In addition, in the lighting apparatus of the present first embodiment, the state is maintained in which the surface of the spherical end portion 3*a* of the heat transfer unit 3 is kept in contact with the surface of the spherical-end receiving section 101*b* at all times. Thereby, heat generated by the light-emitting diode 4 during light emission can efficiently be transferred to the heat transfer unit 3. Concurrently, the heat, which has thus been transferred to the heat transfer unit 3, can be transferred to the heat dissipation unit 2 at a high speed through the heat transfer unit 3 that has superior heat transfer properties.

Hereinbelow, the lighting apparatus of the present first embodiment will be described more in detail.

(Heat Transfer Unit 3)

In the present first embodiment, the heat pipe used as the heat transfer unit 3 is formed such that heat-transferring working fluid, such as water, a freon gas, a substitute freon gas, or fluorinert, is hermetically enclosed in a metal pipe formed by a metal material, such as copper or aluminum material, in which the following series of operations is iterated. The working fluid is heated in a heat-input section (high temperature section), and the fluid is thereby vaporized. The vapor then flows to a heat dissipation section (low temperature section) and dissipates heat, and is thereby liquefied; and thus-liquefied working fluid is returned according to a capillary tube phenomenon. By iterating these operations, the heat pipe works as a heat transfer member and exhibits very high heat conductivity.

(Movable Connection of the Light-Emitting Unit 1 and the Heat Transfer Unit 3)

Figure 2:
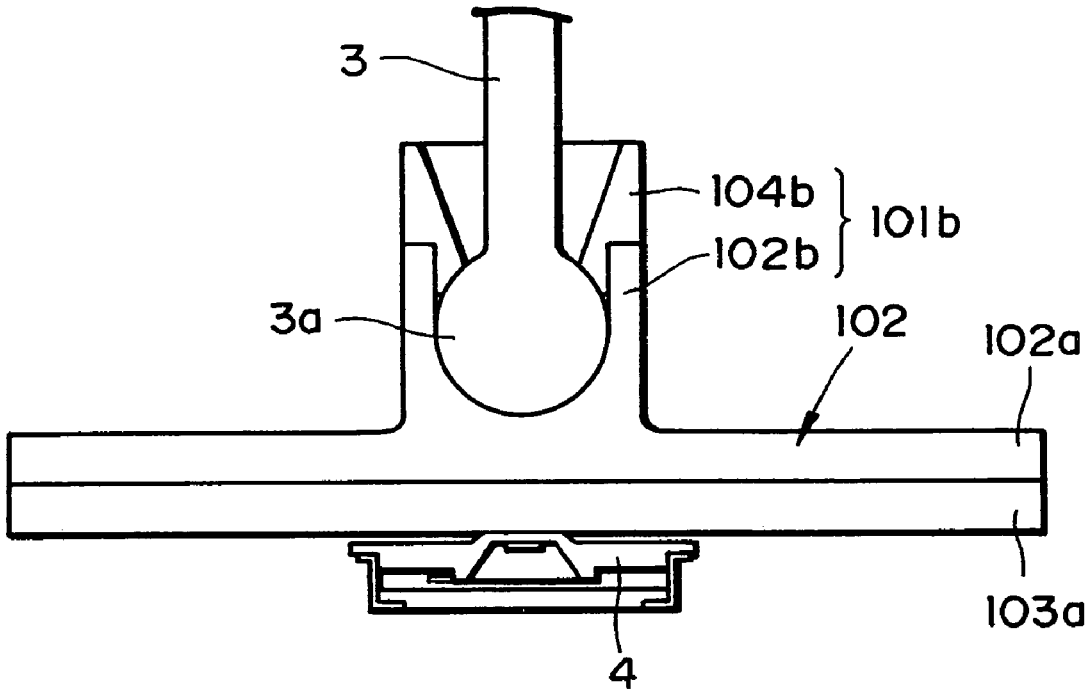
FIG. 2 is a cross-sectional view of the light-emitting unit of the lighting apparatus according to the first embodiment.

As shown in FIG. 2, in the lighting apparatus of the present first embodiment, the base 101 is formed from a metal base 102, a base plate 103*a*, and a stopper 104*b*.

The metal base 102 is formed from a metal material used to integrally form a plate section 102*a* and a receiving section 102*b*. A wiring for supplying power to the light-emitting diode 4 is formed on the base plate 103*a*, and the light-emitting diode 4 is mounted on an upper surface thereof. The base plate 103*a* on which the light-emitting diode 4 is provided is joined to the upper surface of the plate section 102*a*.

As shown in FIG. 2, the receiving section 102*b* includes an undersurface formed to have a semispherical surface having the same diameter as that of the spherical end portion 3*a*. The heat transfer unit 3 is inserted into the receiving section 102*b* so that the surface of the spherical end portion 3*a* engages with the undersurface. Then, a stopper 104*b* is fitted into the metal base 102 to prevent disengagement of the heat transfer unit 3. In this manner, the spherical end portion 3*a* is supported rotatably.

In the present embodiment, a grease having high heat conductivity is preferably applied into the engagement portion so that the spherical end portion unit 3*a* smoothly rotates in the receiving section 102*b* and the heat efficiently transfers from the metal base 102 to the heat transfer unit 3.

(Fixed Portion of the Light-Emitting Unit 1)

The light-emitting unit 1 is fixed to a mounting surface (not shown) by using a movable luminous distribution cover 16 that includes fixed flanges 12 and 14 and a light emanation opening 16*a*.

In the fixed structure, the light-emitting unit 1 is fixed to the movable luminous distribution cover 16 to be movable together with the movable luminous distribution cover 16 while maintaining the positional relationship therebetween. The light-emitting unit 1 is thus fixed so that light emitted therefrom is efficiently emanated out through the light emanation opening 16*a*.

In the lighting apparatus of the present first embodiment, for example, the movable luminous distribution cover 16 is formed by a substantially spherical resin mold body and is provided to be oscillatable along guide faces of fixed flanges 12 and 14 fixed on the mounting surface.

(Connection of the Heat Transfer Unit 3 and the Heat Dissipation Unit 2)

As shown in FIG. 1A, one end portion of the heat transfer unit 3 is bent in the form of the letter "L", and the bent end portion is fitted using a fastening device 15 into a groove formed in the heat dissipation unit 2. Preferably, the fastening device 15 is formed by a metal material having high heat conductivity and is fitted so that the contact area of the heat transfer unit 3, the fastening device 15, and the groove of the heat dissipation unit 2 becomes as large as possible.

In the thus-constructed lighting apparatus of the first embodiment, heat generated by the light-emitting unit 1, as described above, can be transferred at a high speed to the heat dissipation unit 2 and can be efficiently dissipated. Consequently, the temperature rise of the light-emitting unit 1 can be suppressed.

Consequently, the heat dissipation structure used in the present embodiment can suitably be applied to a lighting apparatus, particularly, to a lighting apparatus including a light-emitting unit formed using a semiconductor light-emitting device such as a light-emitting diode or a laser diode.

More specifically, the temperature rise of the light-emitting unit can be reduced to be very low by using the heat dissipation structure of the present embodiment. As such, the service life of the semiconductor light-emitting device can be prolonged, property variations (such as color-tone variations) ascribed to the temperature rise of the device can be suppressed. Consequently, long-term light emission can stably be implemented.

Furthermore, in the movable connection structure of the light-emitting unit 1 and the heat transfer unit 3 according to the first embodiment, the light-emitting unit 1 can be moved without hindering the heat conductivity. Consequently, the directional light of the semiconductor light-emitting device can be effectively used.

Second Embodiment

Figure 3A:
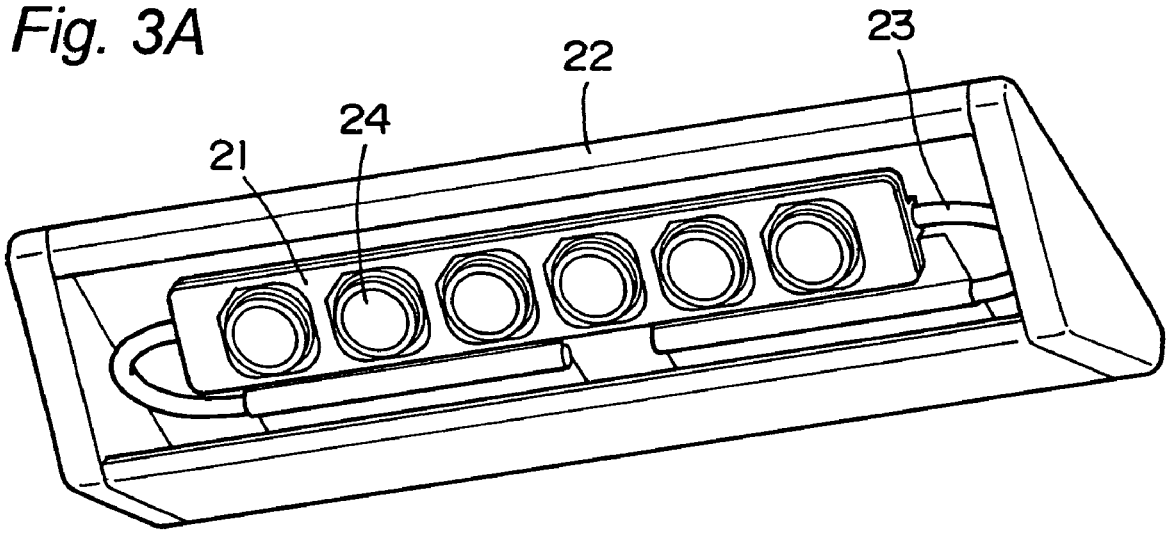
FIG. 3A is an overall perspective view of a lighting apparatus according to a second embodiment of the present invention.
Figure 3B:
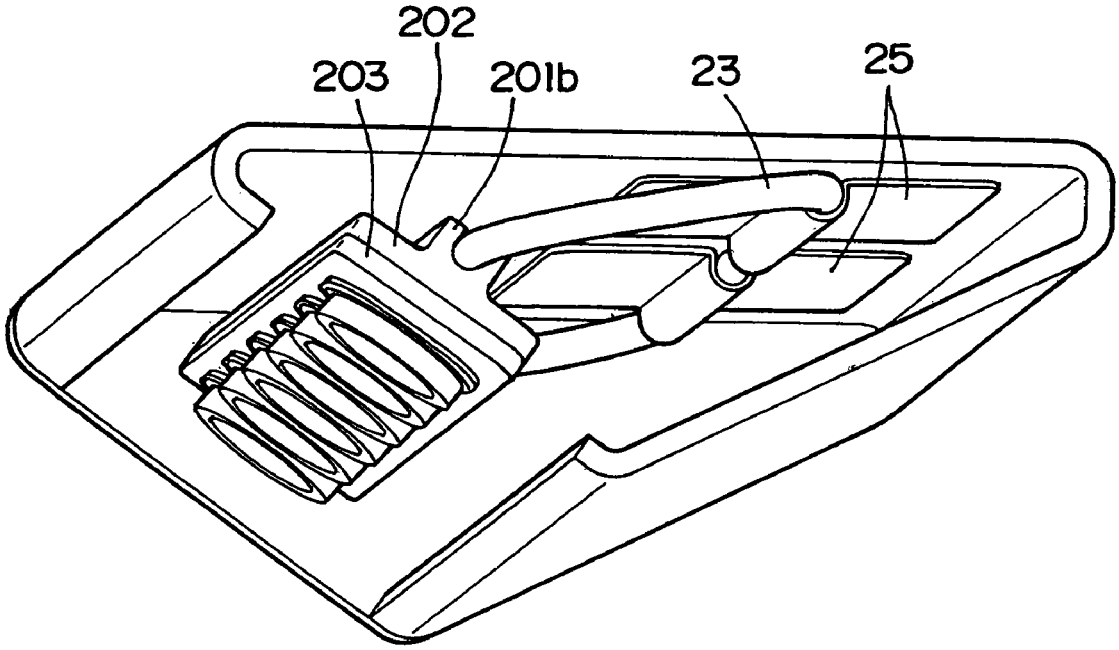
FIG. 3B is a perspective view showing an inner construction (a cover is partly removed) of a light-emitting unit of the lighting apparatus.

By way of a lighting apparatus of a second embodiment, FIGS. 3A and 3B show an example lighting apparatus constructed using a plurality of optical sources 24 (each formed by, for example, light-emitting diodes) aligned in a straight line. More specifically, the lighting apparatus is constructed as described hereunder.

The lighting apparatus of the second embodiment is constructed such that a light-emitting unit 21 and a heat dissipation unit 22 concurrently used as a cover are connected to one another via a heat transfer unit 23 (heat pipe). The basic construction elements are identical to those of the first embodiment.

In the lighting apparatus of the present second embodiment, the heat transfer unit 23 is fabricated such that the heat pipe having a circular cross section is formed to be ring-like, and a portion thereof that extends linearly is used to connect the light-emitting unit 23 and the heat dissipation unit 22 to one another.

In the second embodiment, as shown in FIG. 3A, a first connection portion of the heat transfer unit 23 to the light-emitting unit 21 and a second connection portion of the heat transfer unit 23 to the heat dissipation unit 22 are provided parallel and opposite to each other.

The light-emitting unit 21 has a construction including a base 202 (which is preferably formed by a metal material having high heat conductivity), a base plate 203, and the plurality of light-emitting diodes 24. On the back face of the base 202, a receiving section 201*b* into which the first connection portion of the heat transfer unit 23 is fitted is formed. The base plate 203 is joined to the surface of the base 202, and the plurality of light-emitting diodes 24 are disposed on the upper surface of the base plate 203.

As shown in FIG. 3B, the receiving section 201*b* is formed to include a groove formed on a ridge portion provided on the back face of the metal base 202. The groove includes an undersurface formed to have a circumferential surface having the same diameter as that of the first connection portion. And the first connection portion is fitted into the receiving section 201*b* to be in contact with the undersurface of the receiving section 201*b*. In this case, the first connection portion is fitted into the receiving section 201*b* to have strength sufficient to enable a rotatable state to be maintained without causing disengagement from the receiving section 201*b*. In this manner, the light-emitting unit 21 is connected to the heat transfer unit 23 to be rotatable on an axis (a straight line) of the first connection portion in the center. In the present embodiment, grease having high heat conductivity is preferably applied into the engagement portion so that the first connection portion smoothly rotates in the receiving section 201*b* and heat efficiently transfer from the metal base 202 to the heat transfer unit 23.

As shown in FIG. 3B, the second connection portion of the heat transfer unit 23 is fixed to the heat dissipation unit 22, which is concurrently used as the cover, by using fastening devices 25. Preferably, the fastening devices 25 are formed by a metal material having high heat conductivity, and are fitted so that the area where the fastening devices 25 contact the second connection portion of the heat transfer unit 23 becomes as large as possible.

As described above, in the lighting apparatus of the present second embodiment, the light-emitting unit 21 is connected to the heat transfer unit 23 to be rotatable with the axis of the circular-cylindrical first connection portion in the center. In addition, the state is maintained in which the surface of the first connection portion of the heat transfer unit 23 is kept in contact with the inner surface of the receiving section 201*b* at all times. Thereby, heat generated during light emission of the optical sources 24 can efficiently be transferred to the heat transfer unit 23. Concurrently, the heat, which has thus been transferred to the heat transfer unit 23, can be transferred to the heat dissipation unit 22 at a high speed through the heat transfer unit 23 that has superior heat transfer properties.

Accordingly, as in the case of the first embodiment, in the lighting apparatus of the second embodiment, heat generated by the light-emitting unit 21 can be transferred at a high speed to the heat dissipation unit 22 and can be efficiently radiated. Consequently, the temperature rise of the light-emitting unit 21 can be suppressed.

As such, also in the heat dissipation structure used in the present second embodiment, with light-emitting devices being used, the service life thereof can be prolonged, and property variations occurring because of the temperature rise of the devices can be suppressed. Consequently, long-term light emission can stably be implemented.

In the lighting apparatus of the present second embodiment, the tilt angle of the bar-like light-emitting unit 21 can arbitrarily be changed.

(Modification)

Figure 4A:
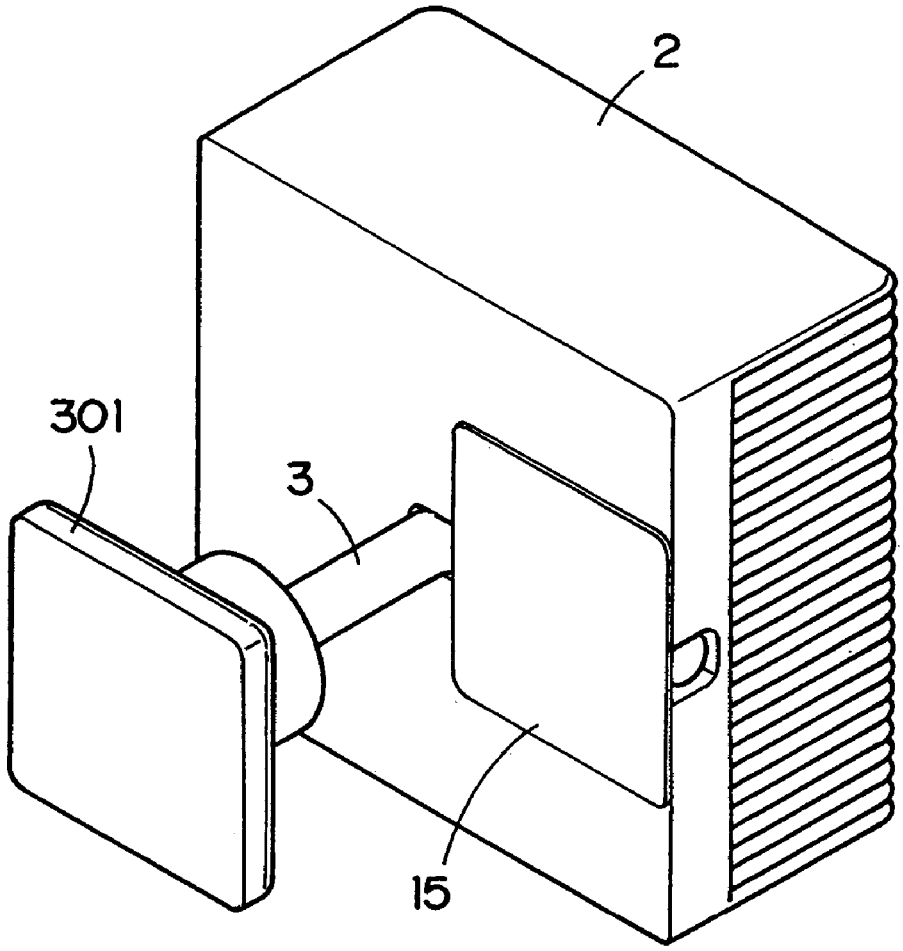
FIG. 4A is a schematic perspective view of a universal luminous distribution mechanism (modified example) similar to the first embodiment of the present invention.
Figure 4B:
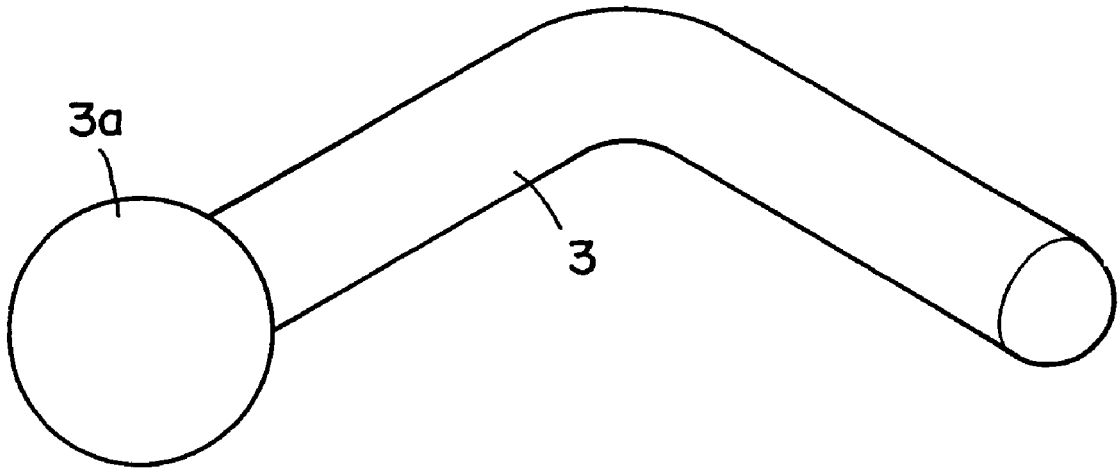
FIG. 4B is a schematic perspective view of a heat transfer unit of the universal luminous distribution mechanism.

FIG. 4A is a perspective view showing a universal luminous distribution mechanism having a construction similar to that of the lighting apparatus according to the first embodiment. FIG. 4B is a perspective view of a heat transfer unit 3. (In the drawings, portions similar and/or corresponding to those in FIGS. 1A and 1B are shown with like reference numerals/symbols). Referring to FIG. 4A, numeral 301 denotes an optical-source mounting section. As described in the first embodiment, the optical-source mounting section 301 is enabled to perform three-dimensional oscillatory rotation with the center of the spherical end portion 3*a* in the center.

Consequently, constructing a lighting apparatus using the universal luminous distribution mechanism enables the provision of the lighting apparatus in which the temperature rise of the optical source can be suppressed, and concurrently, three-dimensional luminous distribution can be implemented.

Figure 5A:
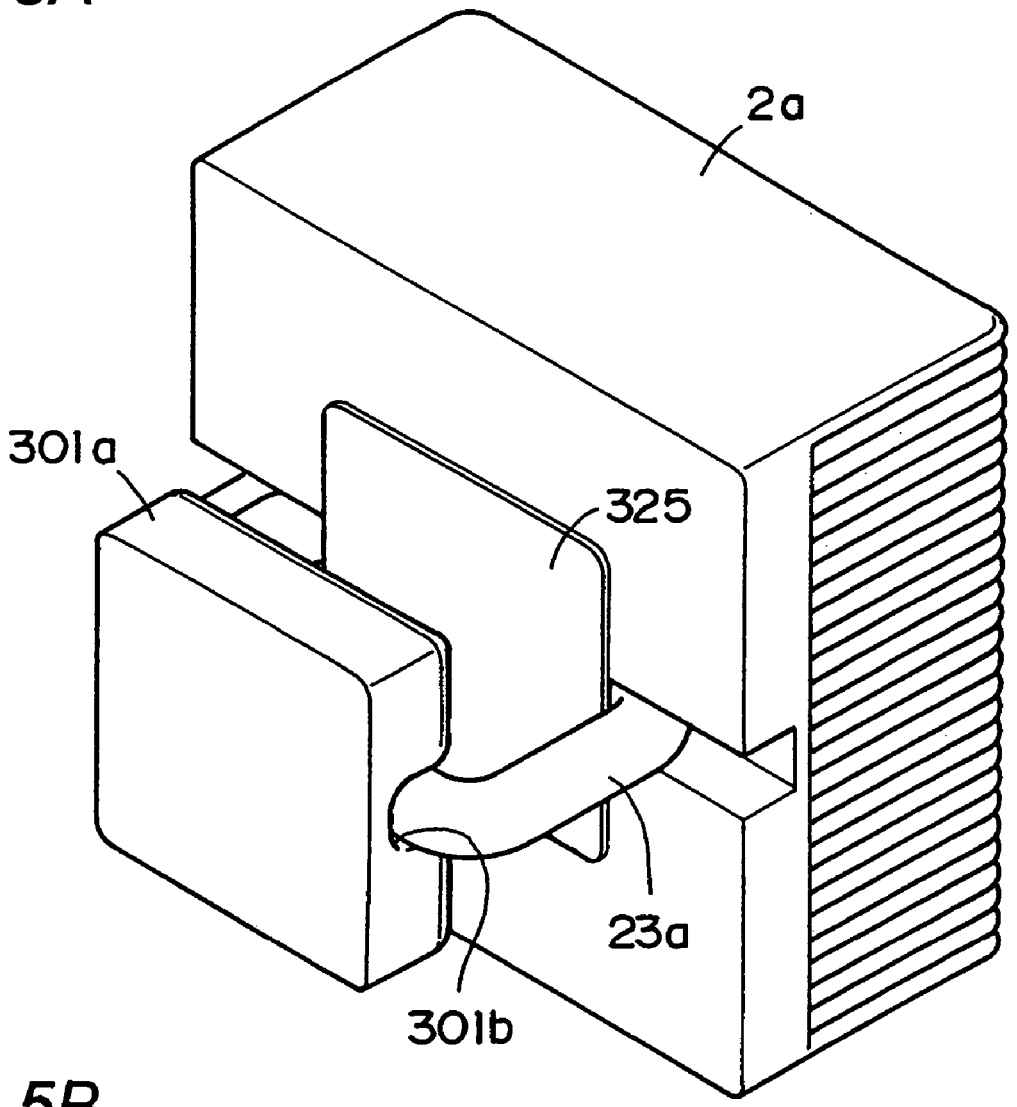
FIG. 5A is a schematic perspective view of a universal luminous distribution mechanism (modified example) similar to the second embodiment of the present invention.
Figure 5B:
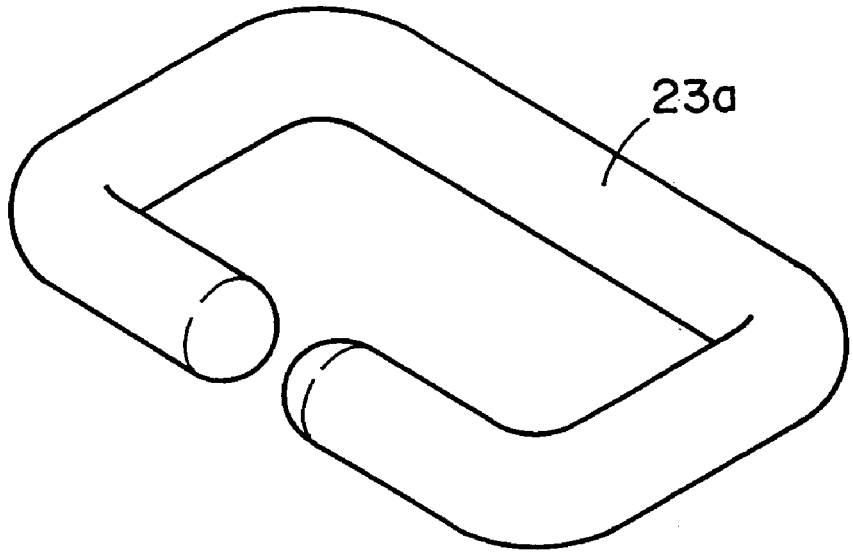
FIG. 5B is a schematic perspective view of a heat transfer unit of the universal luminous distribution mechanism.

FIG. 5A is a perspective view showing a universal luminous distribution mechanism having a construction similar to that of the lighting apparatus according to the second embodiment. FIG. 5B is a perspective view of a heat transfer unit 23*a*. (In the drawings, portions similar and/or corresponding to those in FIGS. 3A and 3B are shown with like reference numerals/symbols).

More specifically, in the universal luminous distribution mechanism shown in FIGS. 5A and 5B, an optical-source mounting section 301*a* is connected to a heat dissipation unit 2*a* via a heat transfer unit 23*a*

In the universal luminous distribution mechanism shown in FIGS. 5A and 5B, the heat transfer unit 23*a* is fabricated similar to the heat transfer unit 23 of the second embodiment. That is, a heat pipe having a circular cross section is formed to be ring-like, and one portion (first connection portion) thereof used for connection to the optical-source mounting section 301*a*, and another portion (second connection portion) is used for connection to the heat dissipation unit 2*a*.

On a back face of the optical-source mounting section 301*a*, a receiving groove 301*b* into which the first connection portion of the heat transfer unit 23*a* is fitted is formed. The receiving groove 301*b* includes an undersurface formed to have a circumferential surface having the same diameter as that of the first connection portion. The first connection portion is fitted into the receiving section to be in contact with the undersurface. The first connection portion is fitted into the receiving section to have strength sufficient to enable a rotatable state to be maintained without causing disengagement from the receiving groove 301*b*. In this manner, the optical-source mounting section 301*a* is enabled to perform two-dimensional oscillatory rotation on an axis of the first connection portion in the center. Meanwhile, the second connection portion of the heat transfer unit 23*a* is fixed to the heat dissipation unit 2*a* by using a fastening device 325.

As described above, constructing a lighting apparatus using the universal luminous distribution mechanism shown in FIGS. 5A and 5B enables the provision of the lighting apparatus in which the temperature rise of the optical source can be suppressed, and concurrently, two-dimensional luminous distribution can be implemented.

Figure 6A:
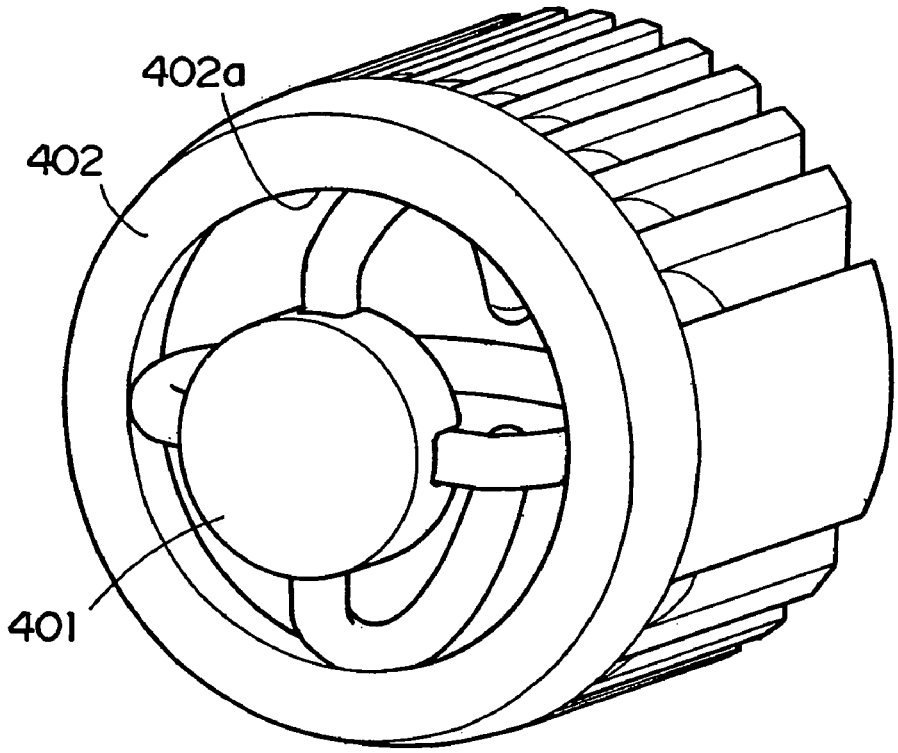
FIG. 6A is a schematic perspective view of a universal luminous distribution mechanism according to a modified example of the present invention.
Figure 6B:
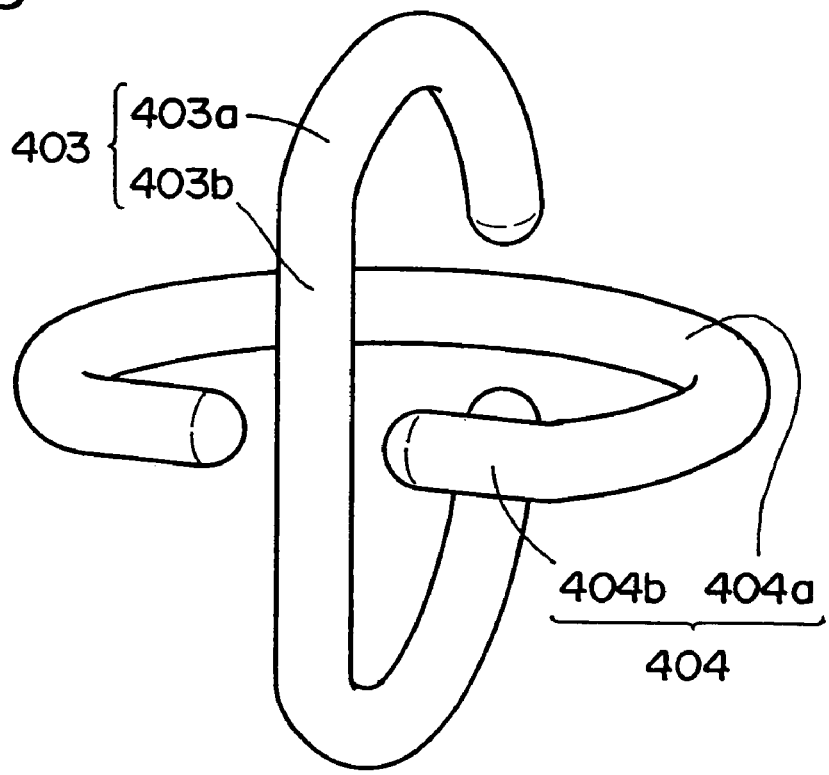
FIG. 6B is a schematic perspective view of a heat transfer unit of the universal luminous distribution mechanism.

FIGS. 6A and 6B show a three-dimensionally oscillatable universal luminous distribution mechanism realized by using a construction different from that shown in FIGS. 4A and 4B. In the universal luminous distribution mechanism shown in FIGS. 6A and 6B, a heat transfer unit has a construction including two rings, namely, heat transfer rings 403 and 404, disposed perpendicular to one another.

The heat transfer rings 403 and 404 are, respectively, constructed to include first connection portions 403*b* and 404*b* provided as straight portions for connection to an optical-source mounting section 401, and second connection portions 403*a* and 404*a* supported in contact with an inner peripheral surface of a heat dissipation unit 402.

An inner peripheral surface of the heat dissipation unit 402 is formed to include a portion of a spherical surface (a portion of a spherical surface including at least a maximum circumference). The respective second connection portions 403*a* and 404*a* of the heat transfer rings 403 and 404 are formed arcuate so that outer peripheries thereof contact to the inner peripheral surface formed by the aforementioned portion of the spherical surface.

In addition, in the universal luminous distribution mechanism shown in FIGS. 6A and 6B, the optical-source mounting section 401 is supported such that a groove perpendicularly formed on a back face thereof is engaged with the first connection portions 403*b* and 404*b* disposed perpendicular to one another.

In the manner described above, the optical-source mounting section 401 is supported oscillatable with respect to the heat dissipation unit 402 via the heat transfer unit while maintaining high heat transfer properties.

Consequently, when a lighting apparatus is constructed in the universal luminous distribution mechanism shown in FIGS. 6A and 6B by mounting various light-emitting devices to the optical-source mounting section 401, the lighting apparatus can be provided in which the temperature rise of the optical source can be suppressed, and concurrently, three-dimensional luminous distribution can be implemented.

As above, while each of the embodiments has been described with reference to the example in which the heat pipe is used as the heat transfer unit, the invention is not limited thereto. The invention may be constructed using a different material such as a metal material having high heat conductivity.

In addition, while the lighting apparatus of the first embodiment has been described referring to the example construction using the single light-emitting diode, and the lighting apparatus of the second embodiment has been described referring to the example construction including the plurality of light-emitting diodes aligned along the single line, the invention is not limited thereto. The invention may be constructed in various other ways. For example, the invention may be constructed using a plurality of light-emitting diodes two-dimensionally aligned. Alternatively, the invention may be constructed using light-emitting diodes aligned in a different predetermined pattern corresponding to specific luminous distribution properties in order to obtain the properties.

Further, as already described above, in the present invention, the optical source is not limited to the light-emitting diode.

Furthermore, while the light-emitting unit and the heat transfer unit are rotatably connected to one another in each of the first and second embodiments and the modified examples, the invention is not limited thereby. The heat dissipation unit and the heat transfer unit may be rotatably connected to one another. Alternatively, the light-emitting unit and the heat transfer unit may be rotatably connected, and concurrently, the heat transfer unit and the heat dissipation unit may be rotatably connected.

Even in each of the above arrangements, effects and advantages equivalent to those in each of the first and second embodiments can be obtained.

Third Embodiment

Embodiment 3

Figure 7A:
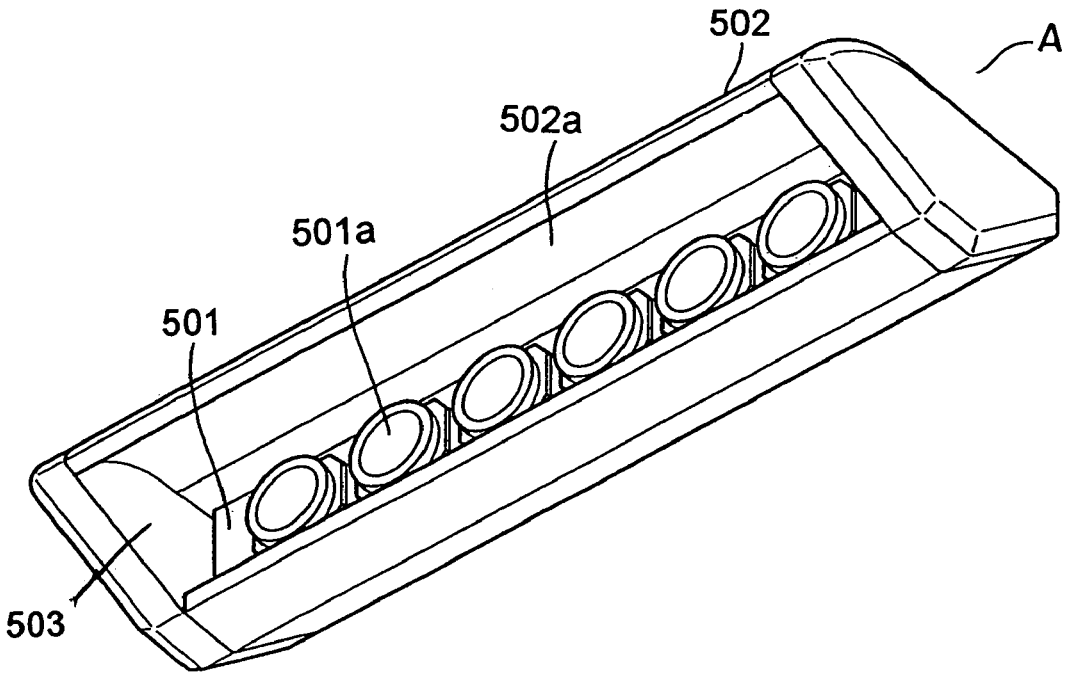
FIG. 7A is a perspective view illustrating one example of an arrangement of the lighting apparatus according to embodiment 3 of the invention.
Figure 7B:
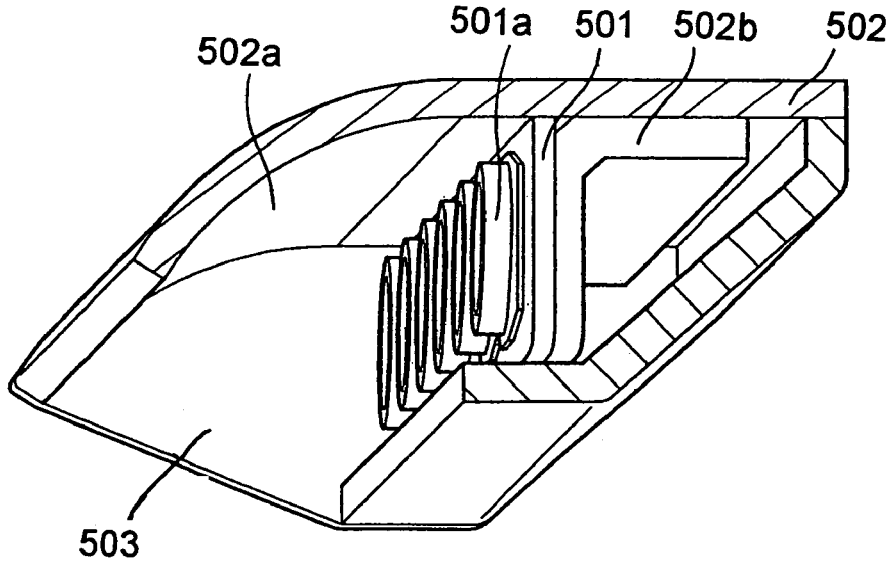
FIG. 7B is a perspective view illustrating a partial cross-sectional view of FIG. 7A.

FIGS. 7A and B are schematic views for illustrating one example of a construction of a lighting apparatus A according to the present embodiment, wherein the lighting apparatus is of a stationary type that is used by fixing the apparatus to a wall or a pillar. FIG. 7A is a perspective view of the lighting apparatus A and FIG. 7B is a perspective view illustrating a partial cross-sectional construction of the lighting apparatus A.

The lighting apparatus A has a reflection unit 502 formed by a case body having an irradiation opening 503 on a front side thereof, and a light-emitting unit 501 provided with a plurality of light-emitting diodes 501*a* aligned in a linear manner and fixedly arranged in the interior of the reflection unit 502, wherein irradiated light from the light-emitting unit 501 is reflected by a reflection surface 502*a* provided on an inner peripheral surface of the reflection unit 502 whereupon this reflected light is irradiated through the irradiation opening 503. Here, the reflection surface 502*a* has a reflection layer containing therein ceramics for irradiating far-infrared rays. The light-emitting unit 501 is fixedly arranged at a fixing member 502*b* that is fixedly arranged in the interior of the reflection unit 502 such that irradiated light from the light-emitting diodes 501*a* may be irradiated onto the reflection surface 502*a*. The lighting apparatus A is fixed by being mounted to a wall surface (not shown) by means of an attaching portion (not shown) provided on a rear surface of the reflection surface 502.

A metallic material of favorable heat dissipation properties such as aluminum or stainless steel may be used for the reflection unit 502. Its shape is not particularly limited as long as it is a case body provided with the irradiation opening on the front side thereof and having a space capable of accumulating the light-emitting unit 501 in the interior thereof. Further, while the fixing member 502*b* for fixedly arranging the light-emitting unit 501 may be either arranged integrally or separately from the reflection unit 502, when it is arranged as a separate body, it is preferable to employ a metallic material of favorable heat dissipation properties such as aluminum or stainless steel for the purpose of effectively transferring heat of the light-emitting unit 501 to the reflection unit 502.

While known materials that irradiate far-infrared rays may be employed as the ceramics that is contained in the reflection layer, it is preferable to employ a sintered body in which one or more oxides selected from a group consisting of $Al_2O_3$, $SiO_2$, $SnO_2$, MgO, CaO, $ZrO_2$, $TiO_2$ and $Li_2O$ is employed as a raw material for sintering at a specified temperature. It is more preferably a sintered body having any one composition of $Al_2O_3$—$SiO_2$, $ZrO_2$—$SiO_2$, $TiO_2$—$Al_2O_3$, $Al_2O_3$—$SiO_2$—$TiO_2$, $Al_2O_3$—$SiO_2$—$SnO_2$. The reason is that those are capable of strongly irradiating far-infrared rays.

The reflection layer may be formed by preparing an application liquid upon dispersing binder resin and the above sintered body into a solvent consisting of water or an organic solvent, by applying the application liquid onto an inner peripheral surface of the reflection unit 502 and by removing the solvent at room temperature or through heating. Application of the application liquid may be performed through methods such as spray atomization, roll coating or brush application. Here, it is preferable that a film thickness of the reflection layer is not more than 200 μm. When the thickness is larger than 200 μm, the heat conductivity of the reflection layer itself will be degraded so that heat from the light source is hardly transferred onto the surface of the reflection layer. Far-infrared rays will accordingly be hardly irradiated from the surface of the reflection layer. Further, by mixing a specified amount of fluorescent materials to the above application liquid, it is also possible to form a reflection layer containing fluorescent materials.

The light source of the light-emitting unit 501 may have one or more light-emitting diodes 501*a* disposed at specified positions. The arrangement of the light source is not particularly limited, and it is possible to dispose them in a single line in a linear manner or to dispose them linearly in a plurality of lines.

In the present embodiment 3, since heat generated at the light-emitting unit 501 is transferred to the reflection unit 502 via the fixing member whereupon the heat is dissipated from the reflection layer of the reflection unit 502 as far-infrared rays, it is possible to omit a conventional type heat dissipation unit such as a heat dissipation fin, and the lighting apparatus may be downsized. Particularly when semiconductor light-emitting elements such as light-emitting diodes 501*a* are employed as the light source, it is possible to achieve downsizing of the lighting apparatus while suppressing increases in the temperature of the light-emitting unit 501, and it is possible to obtain a lighting apparatus of small size, of high luminance and that is capable of performing light emission in a stable manner over a long period of time.

It should be noted that the lighting apparatus of the present embodiment 3 might be provided with a universal luminous distribution mechanism similar to that of embodiment 2 whereby the apparatus will exhibit effects similar to those of embodiment 2 in addition to the above-described effects.

Fourth Embodiment

Embodiment 4

Figure 8A:
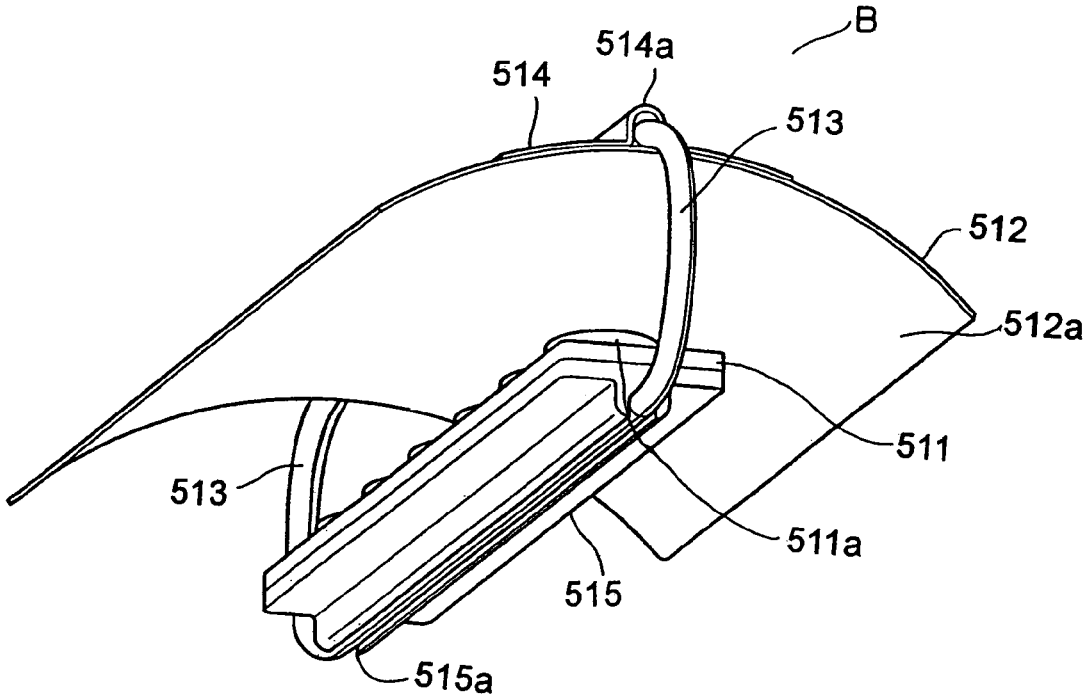
FIG. 8A is a perspective view of a lighting apparatus according to embodiment 4 of the invention seen from below.
Figure 8B:
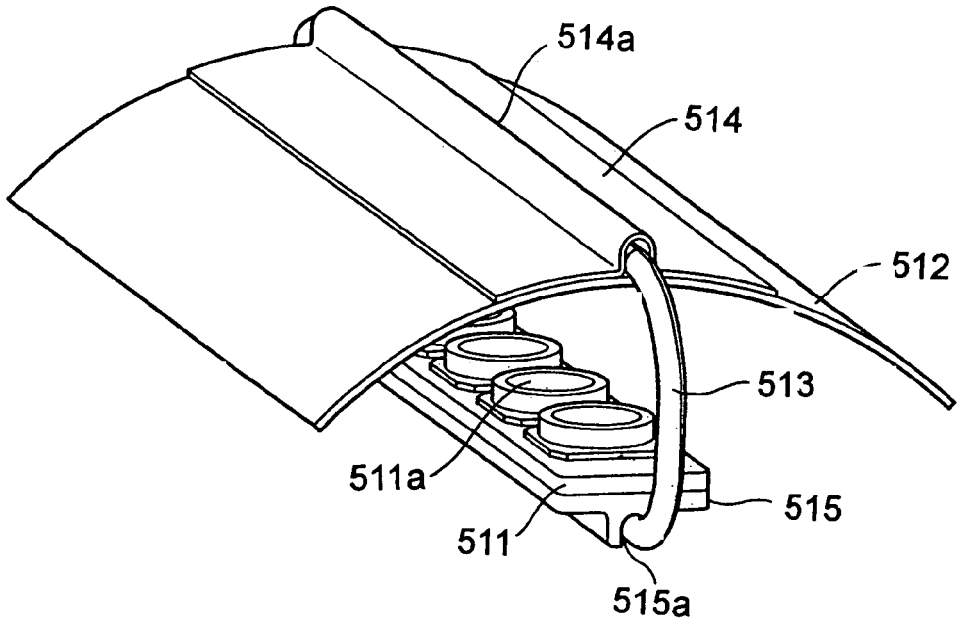
FIG. 8B is a perspective view of the lighting apparatus according to the embodiment 4 seen from above.

The lighting apparatus according to the present embodiment 4 is a lighting apparatus that is arranged in that heat generated at the light-emitting unit is transferred to the reflection unit via the heat transfer unit. FIGS. 8A and B are schematic views for illustrating one example of a construction of a lighting apparatus B according to the present embodiment, wherein the lighting apparatus is of a pendant type that is used by suspending the apparatus from a ceiling or similar. FIG. 8A is a perspective view of the lighting apparatus seen from below and FIG. 8B is a perspective view of the lighting apparatus seen from above.

The lighting apparatus B has a light-emitting unit 511 provided with a plurality of light-emitting diodes 511*a* aligned in a linear manner, a reflection unit 512 provided with a reflection surface 512*a* having a reflection layer containing therein ceramics for irradiating far-infrared rays and concurrently serving as a cover for the light-emitting unit, and a heat transfer unit 513 is a ring-like heat pipe that is supported by the reflection unit 512 for transferring heat that is generated at the light-emitting unit 511 to the reflection unit 512 and concurrently serving as a suspending member for suspending the light-emitting unit 511. Irradiated light from the light-emitting unit 511 is reflected by the reflection surface 512*a* of the reflection unit 512 whereupon the reflected light is irradiated downward of the light-emitting unit 511. Since the reflection unit 512 concurrently serves as a heat dissipation unit, the arrangement does not require a heat dissipation unit. It should be noted that a hanging member (not shown) is connected to a connecting member (not shown) provided at the reflection unit 512 such that the lighting apparatus B may be hung from a ceiling or similar.

The reflecting layer and the light-emitting unit 511 employed in the present embodiment 4 may be identical to those of embodiment 3. Points that differ from those of embodiment 3 will now be explained.

(Reflection Unit 512)

The reflection unit 512 has a thin plate having a warped shape projecting in a light-pointing direction of the light-emitting unit 511 and is disposed to cover the light-emitting unit 511. Further, a heat pipe supporting portion 514 provided with a projecting streak portion 514*a* with a through hole into which a heat pipe may be inserted with play is disposed on the opposite surface of the reflection surface.

(Light-Emitting Unit 511)

On the other hand, the light-emitting unit may be identical to that of embodiment 3 only differing therefrom in that it is provided with a heat pipe fixing portion 515 for fixing a heat pipe on a rear surface thereof. The heat pipe fixing portion 515 is provided with an engaging groove 515*a* extending in a longitudinal direction, wherein a lower portion of the heat pipe is engaged with the engaging groove 515*a* for fixing the heat pipe to the light-emitting unit 511.

(Heat Pipe)

The construction and the heat transfer theory of the heat pipe are identical to those as explained in connection with embodiment 1.

The heat pipe employed in embodiment 4 is of ring-like shape which has a cross-section that is substantially circular, wherein its upper portion is inserted with play into the through hole of the projecting streak portion 514*a* of the heat pipe supporting portion 514 of the reflection unit 512 to be supported to be rotatable, while its lower portion opposing the upper portion is engaged with an engaging groove of the heat pipe fixing portion 515 of the light-emitting unit 511 to be fixed thereat. With this arrangement, the light-emitting unit 511 may be suspended from the reflection unit 512 to be rotatable.

In embodiment 4, heat generated at the light-emitting unit 511 is dissipated from the reflection layer of the reflection unit 512 as far-infrared rays similarly to embodiment 3, so that it is possible to omit a conventional type heat dissipation unit such as a heat dissipation fin for achieving downsizing of the lighting apparatus.

It should be noted that while embodiment 4 has been illustrated as an example in which the heat transfer unit is provided in a pendant type lighting apparatus, the same effects as those of embodiment 4 may be achieved by providing the heat transfer unit between the light-emitting unit and the reflection unit in the lighting apparatus of a stationary type as illustrated in embodiment 3. For instance, by providing a heat plate instead of the fixing member of embodiment 3, heat generated at the light-emitting unit may be rapidly transferred to the reflection unit.

As explained so far, since the lighting apparatuses of embodiments 3 and 4 of the invention are arranged in that the reflection surface of the reflection unit is a surface of a reflection layer containing therein ceramics for dissipating far-infrared rays and in that heat generated at the light-emitting unit is dissipated from the reflection layer as far-infrared rays, it is possible to reduce the size of a conventional type heat dissipation unit such as a heat dissipation fin or to even omit it. With this arrangement, when employing semiconductor light-emitting elements such as light-emitting diodes as a light source, downsizing of the lighting apparatus may be achieved while suppressing increases in the temperature of the light-emitting unit. It is accordingly possible to provide a lighting apparatus of small size, of high luminance and that is capable of performing light emission in a stable manner over a long period of time. Since it is possible to omit the heat dissipation unit, the degree of freedom of design will be improved so that it is also possible to provide a lighting apparatus of superior design. Since the apparatus exhibits insect repelling effects, it is hygienic since the lighting apparatus or its periphery will not become dirty.

As explained so far, by forming a reflection layer on the reflection unit containing ceramics for dissipating far-infrared rays in embodiments 3 and 4, heat dissipation properties of the heat dissipation unit have been improved to add functions to the reflection unit as a heat dissipation unit.

However, it is also possible to further improve heat dissipation properties of the heat dissipation unit by coating ceramics dissipating far-infrared rays or by coating a layer containing such ceramics onto the heat dissipation unit.

More particularly, by performing coating of ceramics dissipating far-infrared rays onto the surface of the heat dissipation unit of embodiments 1 and 2, heat dissipation properties of the heat dissipation unit may be improved.

Fifth Embodiment

Embodiment 5

The lighting apparatus of embodiment 5 of the invention will now be explained while referring to the drawings. It should, however, be noted that the following embodiment 5 merely illustrates a lighting apparatus for embodying the technical idea of the invention and that the invention is not limited to the lighting apparatus of the following embodiment 5 alone. Sizes or positional relations of members illustrated in the respective drawings may be shown in exaggerated form for the purpose of making explanations explicit.

The lighting apparatus of the present embodiment 5 has a light source such as a light-emitting diode, an electric bulb, or a fluorescent lamp, a reflection unit having a reflection surface for irradiating light from the light source to a front direction of the lighting apparatus, a heat transfer unit for transferring heat of the light source to a heat dissipation unit, and a heat dissipation unit. In the lighting apparatus of embodiment 5, the light source is provided at the heat transfer unit either directly or via a heat conductive base. To the light source, electric power is supplied from external electrodes through a conductive substrate or a conductive pattern or similar that is disposed on the heat transfer unit. While the heat transfer unit is provided in a light emanation direction with respect to the reflection unit in the lighting apparatus of embodiment 5, it is processed to have a shape with which shielding of such emanated reflected light can be prevented as much as possible.

Concrete examples concerning the lighting apparatus of embodiment 5 will now be explained.

It should be noted that the invention is of course not to be limited by the concrete examples illustrated below.

CONCRETE EXAMPLE 1

Figure 9A:
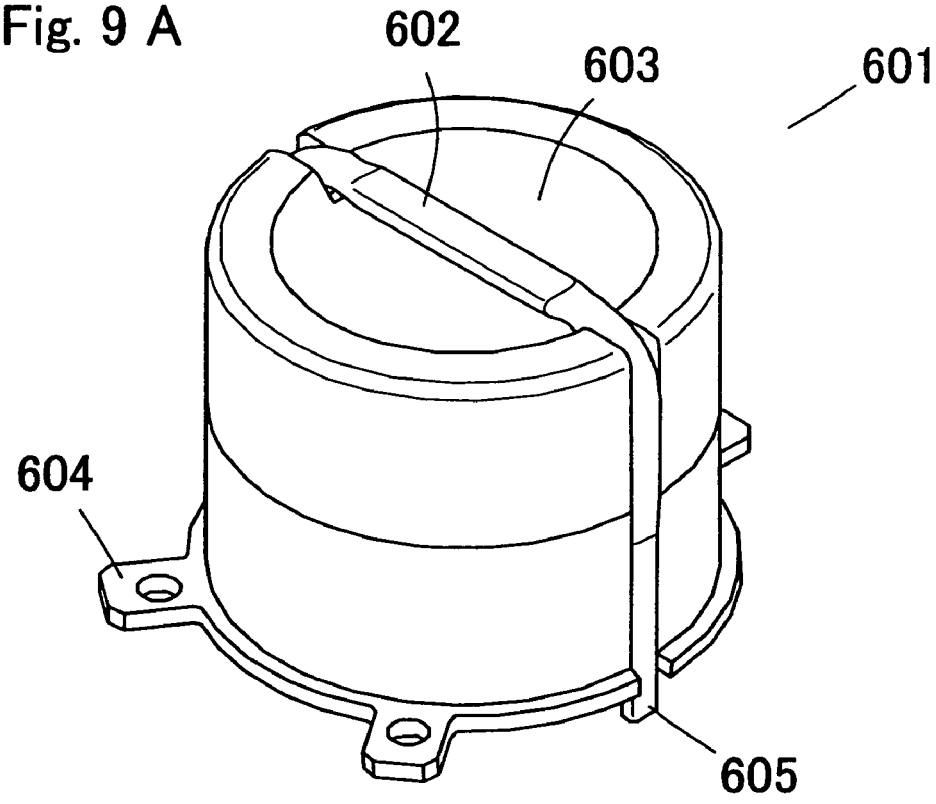
FIG. 9A is a perspective view of a concrete example 1 of the lighting apparatus of embodiment 5 of the invention.
Figure 9B:
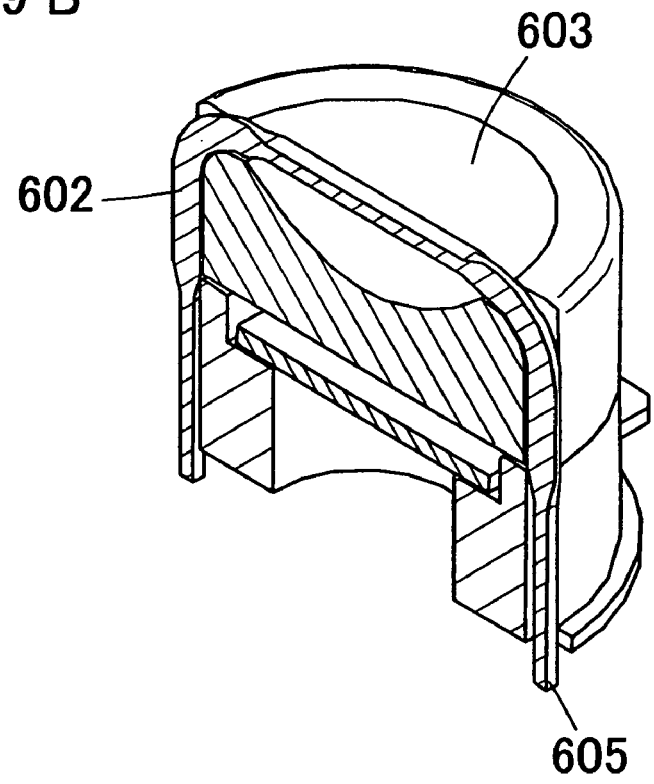
FIG. 9B is a schematic cross-sectional view of the lighting apparatus of FIG. 9A.

FIG. 9A is a perspective view of the lighting apparatus related to concrete example 1 and FIG. 9B is a cross-sectional view of the lighting apparatus related to the present concrete example.

In a lighting apparatus 601 of the concrete example 1, a heat pipe 602 that comprises the heat transfer unit is disposed to cross a front surface of a reflection unit 603 while a light-emitting diode is provided on a rear surface of the heat pipe 602. The heat pipe 602 is bent to face along an outer wall of the lighting apparatus 601 and its end portion 605 is arranged such that it may contact a mounting surface to which the lighting apparatus 601 is mounted. A terminal 604 having a through hole is provided at a bottom surface of the lighting apparatus 601 wherein this terminal 604 is used for fixing purposes while it is possible to directly dissipate heat transferred by the heat pipe 602 onto the mounting surface by directly connecting the end portion 605 of the heat pipe to the terminal 604. A reflection surface of the reflection unit 603 is processed in a shape of a concave mirror that underwent silver plating, and its curvature is adjusted such that light from the light-emitting diode is reflected to obtain collimated beams in a frontward direction (light emanation direction) of the lighting apparatus 601.

In this manner, the light-emitting diode that serves as the light source is mounted to the heat transfer unit either directly or via a heat conductive base of favorable heat conductivity in the lighting apparatus of the concrete example 1. With this arrangement, heat generated at the light-emitting diode during light emission is rapidly transferred to the mounting surface through the heat transfer unit so that increases in the temperature of the light-emitting diode may be effectively suppressed. The lighting apparatus of the present concrete example 1 accordingly exhibits favorable heat dissipation properties and is capable of performing high-output heat dissipation when compared to those of the prior art.

(Mounting Construction of the Light-Emitting Diode in the Concrete Example 1)

Preferred examples of mounting constructions of the light-emitting diode (LED chip) of concrete example 1 will now be explained while referring to the drawings. It should be noted that FIGS. 10A to 10C that are employed in the following explanations of mounting examples illustrate a light source placing surface (rear surface) 692 with the heat pipe 602, which serves as the heat transfer unit, seen from a reflection surface side of the reflection unit.

MOUNTING EXAMPLE 1 FOR THE LIGHT SOURCE

Figure 10A:
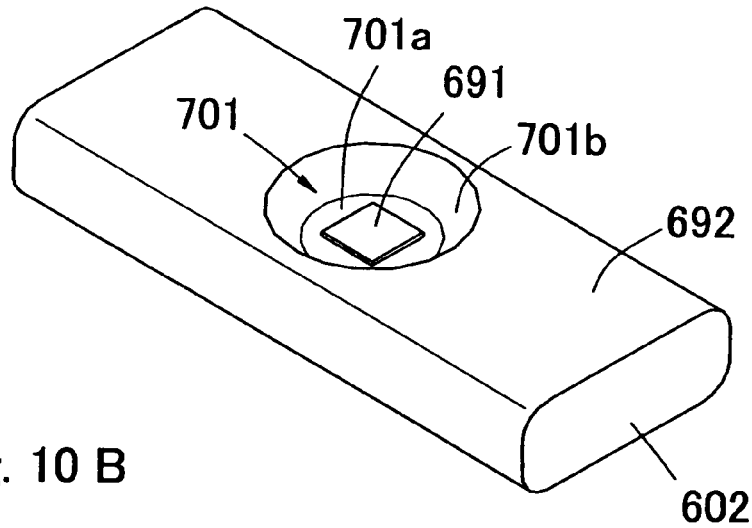
FIG. 10A is a perspective view illustrating a mounting example 1 for the light-emitting diode according to the concrete example 1.

FIG. 10A illustrates one mounting example (hereinafter referred to as mounting example 1) for the light source in the lighting apparatus of the concrete example 1. A light-emitting diode (LED chip) 691 is placed on a bottom surface 701*a* of a concave portion 701 provided on the light source placing surface 692, which is the rear surface of the heat pipe 602, and is made to oppose the reflection surface of the reflection unit. An inner wall surface 701*a* of the concave portion 701 is processed to be of a shape that has an inner diameter that increases in approaching an opening direction and is treated with silver plating.

In the mounting example 1, by the provision of the inner wall surface 701*a* that is inclined for reflecting light that has been emanated from a side surface of the light-emitting diode in the direction of the reflection surface of the reflection unit, light that has been emanated from the side surface of the light-emitting diode may also be effectively used. It is accordingly possible to improve the light-extracting efficiency and to provide a lighting apparatus capable of performing irradiation of even higher output by using a light-emitting diode.

The above mounting example 1 may be applied also in case a plurality of light-emitting diodes is to be mounted. That is, when mounting a plurality of light-emitting diodes, a plurality of concave portions 701 shall be provided so as to mount the light-emitting diodes to the respective concave portions.

MOUNTING EXAMPLE 2 FOR THE LIGHT SOURCE

Figure 10B:
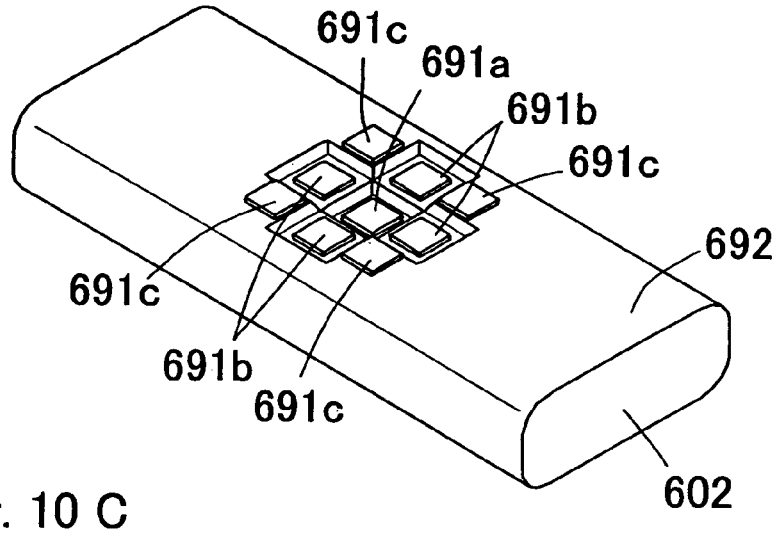
FIG. 10B is a perspective view illustrating a mounting example 2 for the light-emitting diode according to the concrete example 1.

FIG. 10B illustrates another example in which a plurality of LED chips are mounted to the heat pipe 602 in the lighting apparatus of the concrete example 1. In the mounting example 2, step-like concave portions including a plurality of levels are formed on the surface of the heat pipe 602 (light source placing surface 692) onto which the light-emitting diodes 691 are placed so as to prevent a case between adjoining light-emitting diodes in which light emitted from a side surface of one light-emitting diode is irradiated onto the other light-emitting diode. For instance, when mounting 9 light-emitting diodes in a 3 by 3 arrangement, the concave portion for the light-emitting diode 691*a* disposed in the center is formed to be deepest as illustrated in FIG. 10B and inclined inner wall surfaces for reflecting light emitted from a side surface of the light-emitting diode 691*a* in the direction of the reflection unit are formed around the light-emitting diode 691*a* (four directions). Concave portions for the four light-emitting diodes 691*b* adjoining the light-emitting diode 691*a* are formed to be higher by one level than the concave portion for the light-emitting diode 691*a* at the central portion and inclined inner wall surfaces for reflecting light emitted from a side surface of the light-emitting diode 691*b* in the direction of the reflection unit are formed to surround three directions of the respective light-emitting diodes 691*b*. No concave portions are formed for the light-emitting diodes 691*c* that are disposed at the four corners, and the respective light-emitting diodes 691*c* are mounted on the surface of the heat transfer unit (light source placing surface 692). By disposing the plurality of light-emitting diodes upon forming step-like concave portions in the above-described manner, it is possible to avoid a case between light-emitting diodes adjoining in any one of longitudinal, lateral or diagonal directions in which light emitted from a side surface of one light-emitting diode is irradiated onto the other light-emitting diode.

MOUNTING EXAMPLE 3 FOR THE LIGHT SOURCE

Figure 10C:
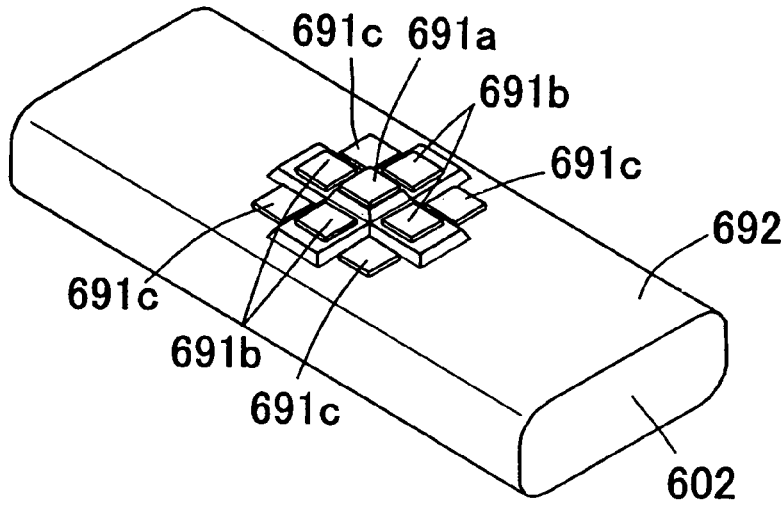
FIG. 10C is a perspective view illustrating a mounting example 3 for the light-emitting diode according to the concrete example 1.

FIG. 10C illustrates another example in which a plurality of light-emitting diodes are mounted onto the heat pipe 602 in the lighting apparatus of the concrete example 1. In the mounting example 3, a plurality of step-like convex portions with a plurality of levels is formed on the surface of the heat pipe 602 (light source placing surface) onto which the light-emitting diodes 691 are placed so as to prevent a case between adjoining light-emitting diodes in which light emitted from a side surface of one light-emitting diode is irradiated onto the other light-emitting diode. For instance, when mounting 9 light-emitting diodes in a 3 by 3 arrangement, the convex portion for the light-emitting diode 691*a* disposed in the center is formed to be highest as illustrated in FIG. 10C and sidewalls of this convex portion comprise inclined surfaces. In this manner, light emitted from side surfaces of the four light-emitting diodes 691*b* adjoining the light-emitting diode 691*a* (side surfaces opposing the central light-emitting diode 691*a*) is made to be reflected by the inclined surfaces of the convex portion for the central light-emitting diode 691*a* in the direction of the reflection unit. The convex portions for the respective light-emitting diodes 691*b* are formed to be lower than the convex portion of the central light-emitting diode 691*a* by one level, and their side walls are formed such that light emitted from side surfaces of the light-emitting diodes 691*c* that are disposed at the four corners is reflected in the direction of the reflection unit. It should be noted that no convex portions are formed for the light-emitting diodes 691*c* that are disposed at the four corners, and the respective light-emitting diodes 691*c* are mounted on the surface of the heat transfer unit (light source placing surface 902). By disposing the plurality of light-emitting diodes upon forming step-like convex portions in the above-described manner, it is possible to avoid a case between light-emitting diodes adjoining in any one of longitudinal, lateral or diagonal directions in which light emitted from a side surface of one light-emitting diode is irradiated onto the other light-emitting diode.

It should be noted that while the above mounting examples 1 to 3 have been explained on the basis of a case in which the light-emitting diodes are directly mounted to the heat pipe that comprises the heat transfer unit, the present mounting examples 1 to 3 are also applicable to a case in which the light-emitting diodes are mounted to the heat transfer unit via a heat conductive base. That is, the above-described concave portions or convex portions shall be formed in such instances on the heat conductive base.

CONCRETE EXAMPLE 2

Figure 11:
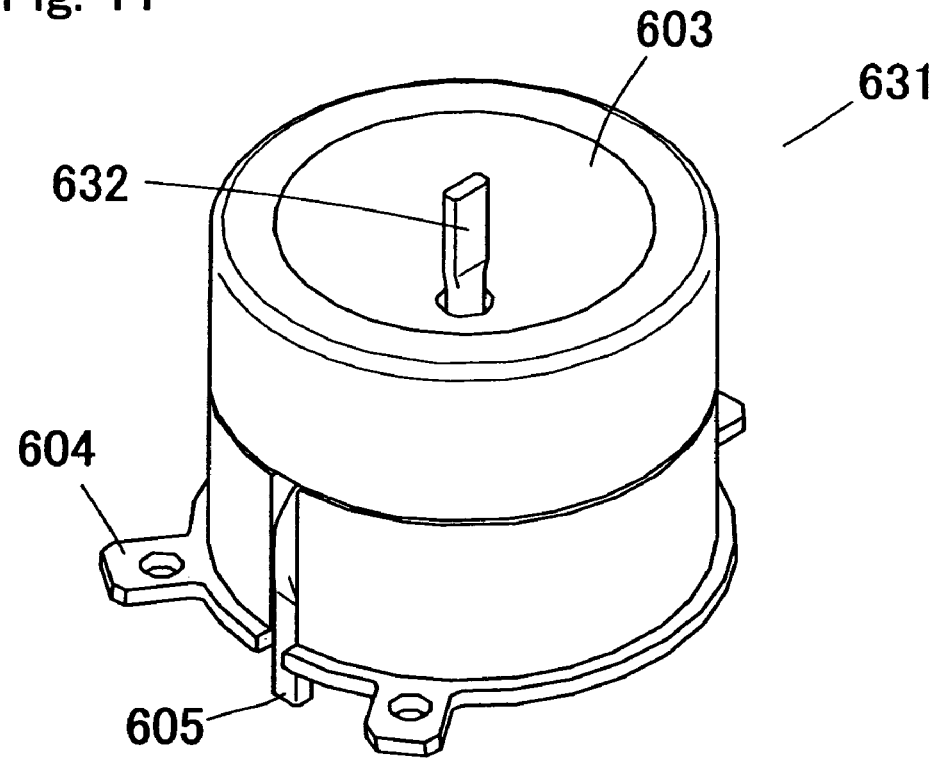
FIG. 11 is a perspective view of a concrete example 2 of the lighting apparatus of embodiment 5 of the invention.
Figure 12:
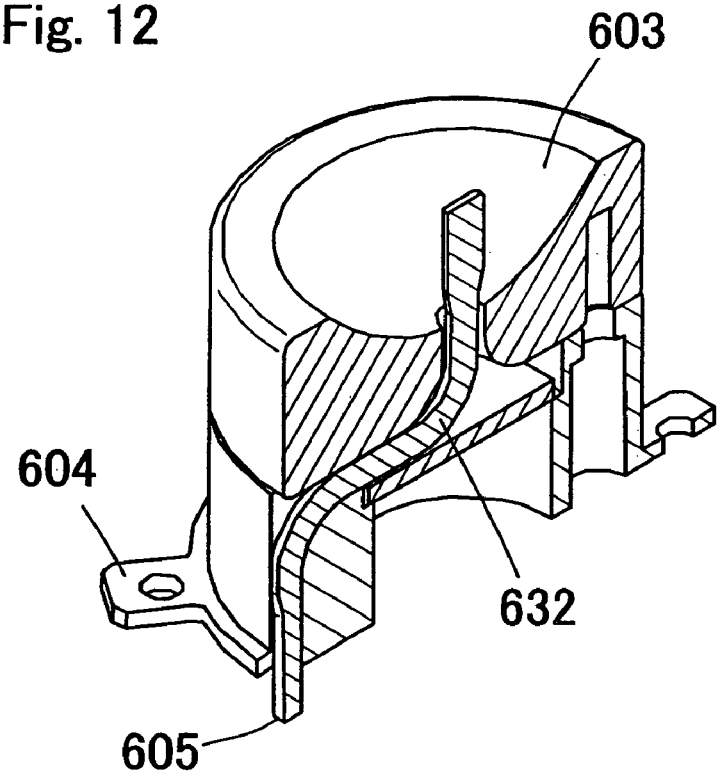
FIG. 12 is a schematic cross-sectional view of the lighting apparatus of FIG. 11.

FIG. 11 is a perspective view of the lighting apparatus of a concrete example 2 related to the embodiment 5 and FIG. 12 a cross-sectional view of the lighting apparatus of the concrete example 2.

In a lighting apparatus 631 of the present concrete example 2, an end portion of a heat pipe 632 comprising the heat transfer unit onto which a light-emitting diode (light source) is placed is made to project from a bottom of a reflection surface (concavely curved surface) of the reflection unit 603. The heat transfer unit 632 is arranged in that a part thereof is bent in a shape of the letter S to face along an outer wall of the lighting apparatus (see FIG. 12) so as to make one end portion 605 of the heat transfer unit 632 contact an external member such as a heat sink. In such a heat transfer unit with a part thereof being bent in a shape of the letter S to face along the outer wall of the lighting apparatus, when a conductive pattern is disposed on a surface of the heat transfer unit 632, it is easy to connect the conductive pattern with external electrodes.

According to the arrangement of the present concrete example 2, it is possible to provide a lighting apparatus capable of performing high-output irradiation by using light-emitting diodes. It is further possible to reduce the area at which light is shielded by the heat pipe 632 when compared to the case of the concrete example 1.

CONCRETE EXAMPLE 3

Figure 13:
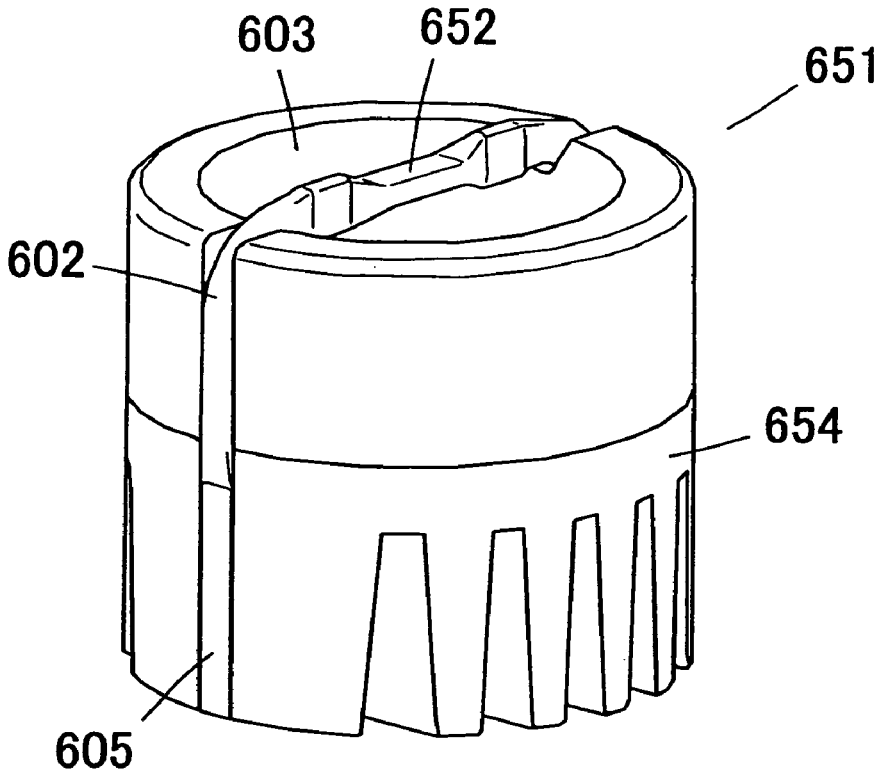
FIG. 13 is a perspective view of a concrete example 3 of the lighting apparatus of embodiment 5 of the invention.
Figure 14:
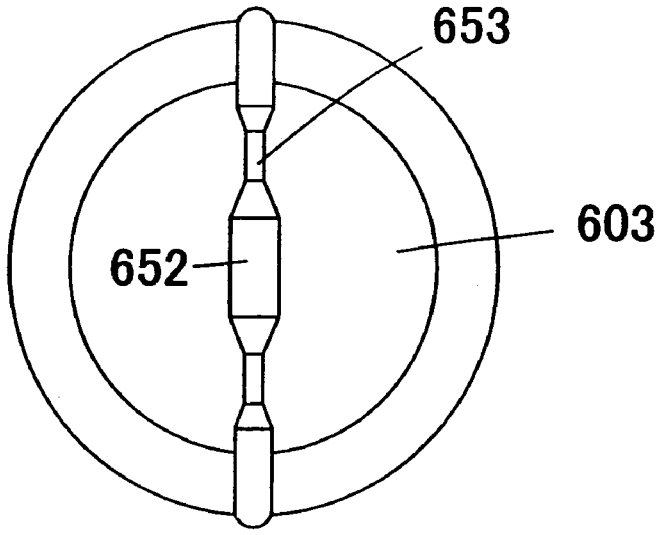
FIG. 14 is a top view of the lighting apparatus of FIG. 13.
Figure 15:
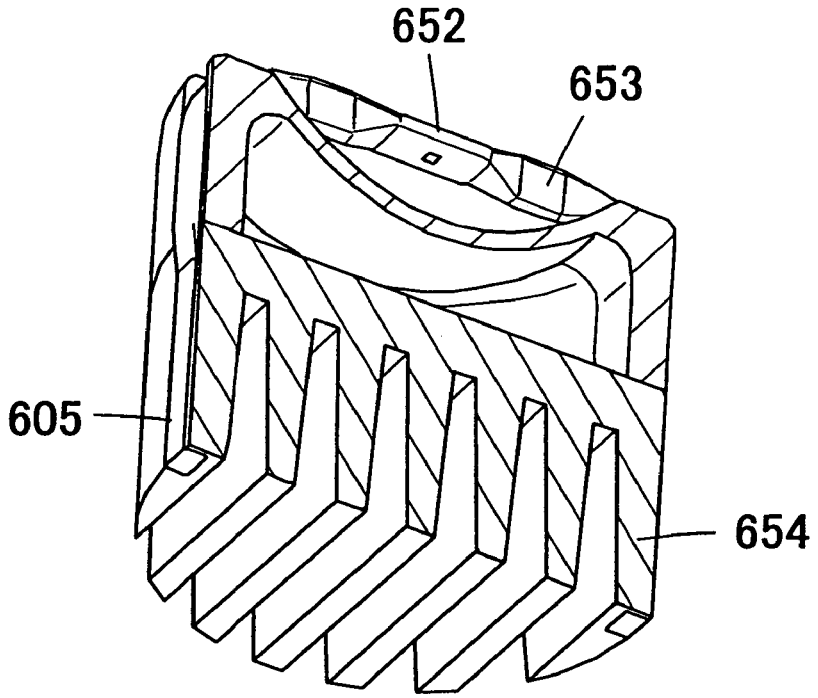
FIG. 15 is a cross-sectional view of the lighting apparatus of FIG. 13.

FIGS. 13, 14 and 15 respectively illustrate a perspective view, a top view and a cross-sectional view of a lighting apparatus of the present concrete example 3.

In a lighting apparatus 651 of the concrete example 3, the heat pipe 602 has a light source placing portion 652 including a rear surface on which a light-emitting diode is mounted and a supporting portion 653 that is provided in succession to the light source placing portion 652, and the thickness of the supporting portion 653 is processed to become smaller than that of the light source placing portion 652. By performing such processing, the amount of light that is shielded by the heat pipe 602 may be reduced and light that is reflected by the reflection surface of the reflection unit 603 may be effectively emanated in the front surface direction of the lighting apparatus to thereby improve the light extracting efficiency of the lighting apparatus. In the lighting apparatus 651 of the present concrete example 3, a heat sink 654 is provided at a lower portion of the lighting apparatus as a heat dissipation unit, and an end portion 605 of the heat pipe 602 is connected to the heat sink 654. By connecting the heat pipe 602 comprising the heat transfer unit and the heat sink 654 comprising the heat dissipation unit, it is possible to further improve the heat dissipation properties of the lighting apparatus.

By employing the arrangement of the present concrete example 3, it is possible to provide a lighting apparatus that is capable of performing high-output irradiation by using a light-emitting diode.

It should be noted that as for the mounting construction for the light-emitting diode of the present concrete example 3, it is possible to apply the mounting examples 1 to 3 as explained in the concrete example 1.

CONCRETE EXAMPLE 4

Figure 16:
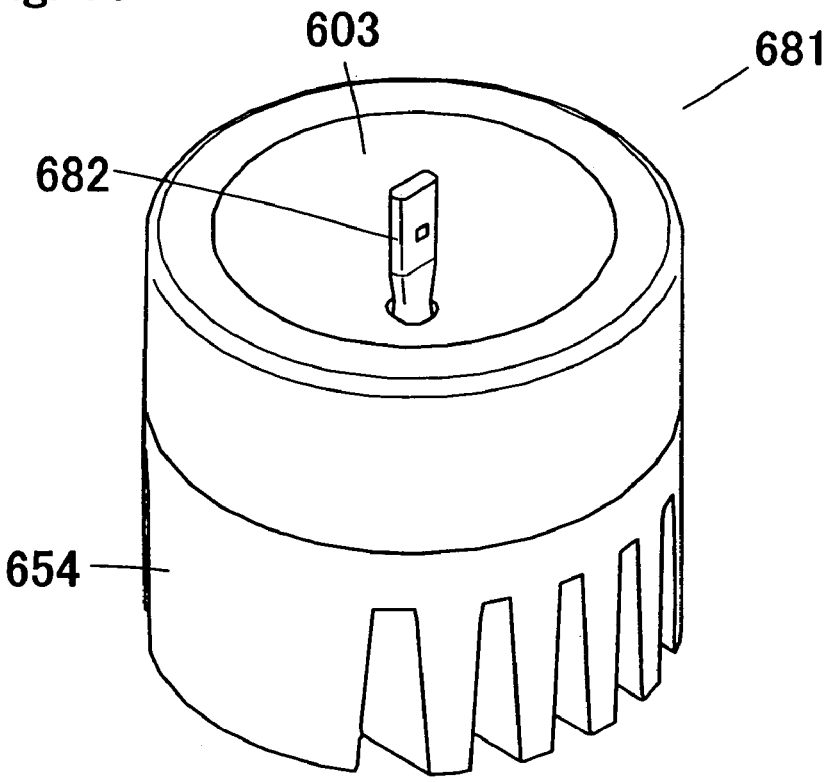
FIG. 16 is a perspective view of a concrete example 4 of the lighting apparatus of embodiment 5 of the invention.
Figure 17:
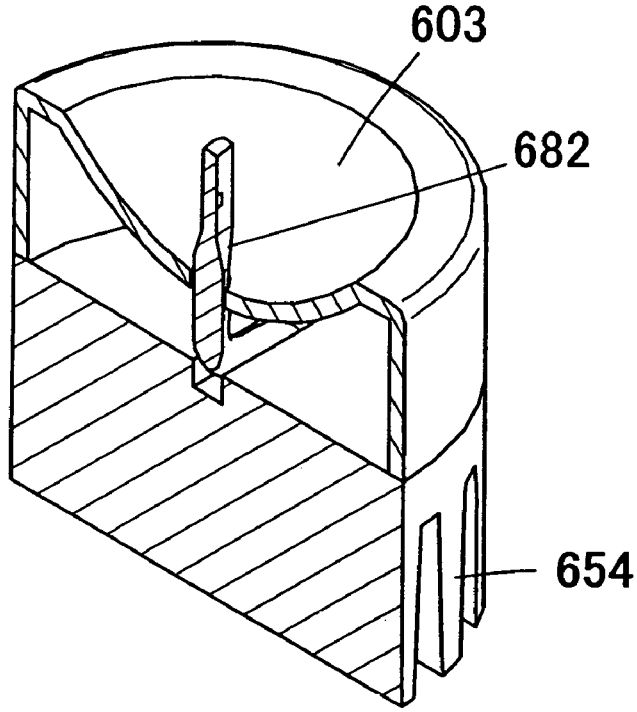
FIG. 17 is a cross-sectional view of the lighting apparatus of FIG. 16.

FIG. 16 is a perspective view of a lighting apparatus of concrete example 4 and FIG. 17 is a cross-sectional view of the lighting apparatus of the present concrete example 4.

In a lighting apparatus 681 related to the present concrete example 4, a heat pipe 682 that comprises the heat transfer unit is made to project from a lowermost bottom portion of a reflection surface (concavely curved surface) of the reflection unit 603. As illustrated in FIG. 17, the heat pipe 682 is bent in a shape of the letter L and is connected to a heat sink 654 attached to a lower portion of the lighting apparatus 681. By employing such a shape for the heat pipe 682, it is possible to increase a contact area between the heat pipe 682 and the heat sink 654 so as to further improve the heat dissipation properties.

By employing the arrangement of the present concrete example 4, it is possible to provide a lighting apparatus that is capable of performing high-output irradiation by using a light-emitting diode. It is further possible to reduce the area at which light that is reflected by the reflection surface is shielded when compared to the case of the concrete example 3.

CONCRETE EXAMPLE 5

Figure 18:
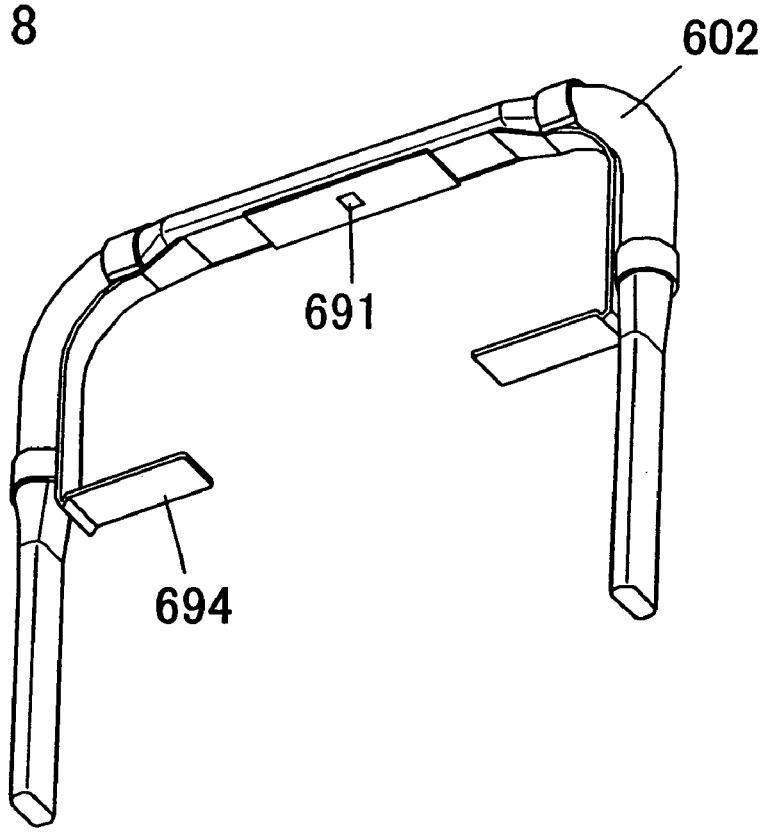
FIG. 18 is a perspective view illustrating a concrete example of a heat transfer unit provided with a conductive substrate according to embodiment 5 of the invention.

FIG. 18 illustrates a condition in which a conductive substrate 694 is attached along an inner surface of a heat pipe 602 in the present concrete example 5. In the present concrete example 5, the conductive substrate 694 is formed by performing pattern printing of a conductive material on to an insulating substrate via an insulating member, and it is processed to have a shape that faces along an inner surface of the heat pipe 602. The size of the conductive substrate 694 is a minimum size with which it is possible to dispose a conductive pattern thereon and it is hidden behind the heat transfer unit 602 so as not to shield irradiated light, that is, such that the conductive substrate 694 cannot be seen when viewing the lighting apparatus from the front. An end portion of the conductive substrate 694 is processed and bent into a shape with which it is easily possible to achieve electric connection with external electrodes. It is preferable that the surface of the conductive substrate 694 is silver-plated. With such an arrangement, light from the light-emitting diode 691 can be reflected by the surface of the conductive substrate 694 in the direction of the reflection unit.

By attaching such a conductive substrate of the present concrete example 5 to an inner surface of the heat transfer unit, it will be possible to supply electric power to the light source without using wiring cords or similar that shield irradiated light.

CONCRETE EXAMPLE 6

Figure 19:
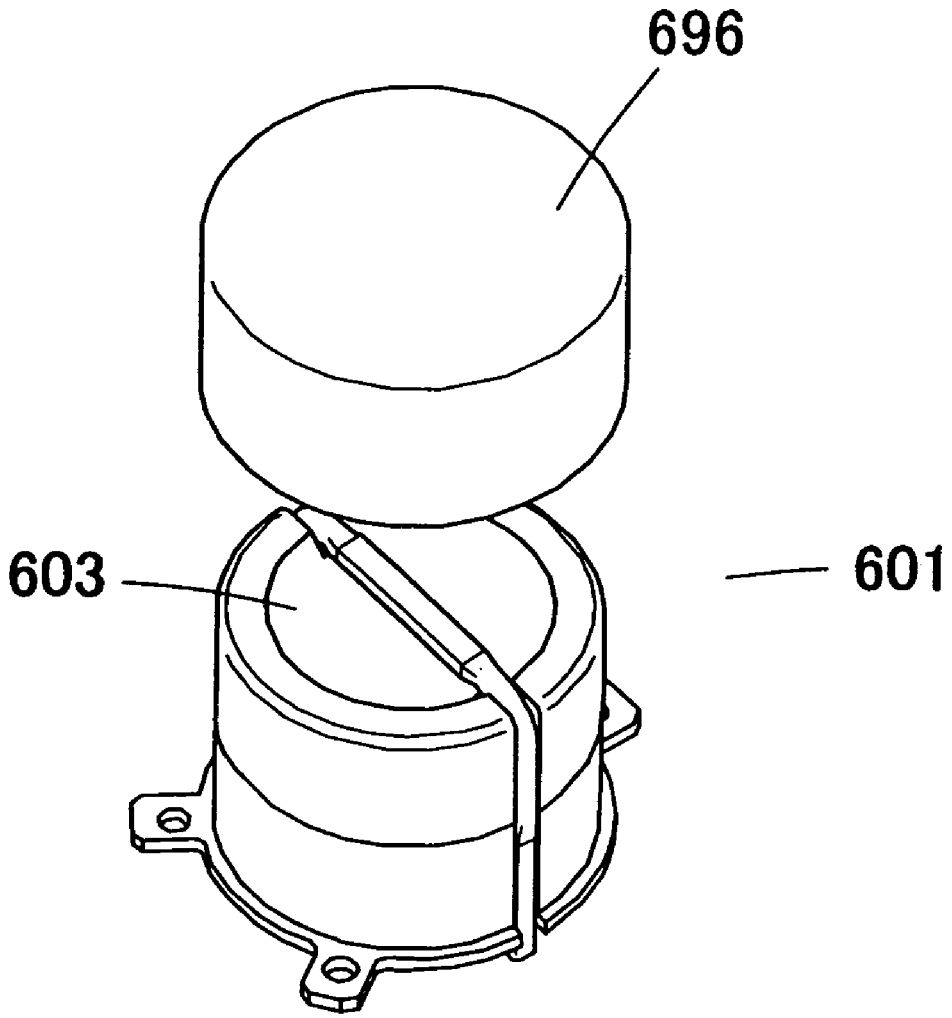
FIG. 19 is a perspective view of a concrete example of the lighting apparatus according to the embodiment 5 of the invention.

FIG. 19 is a schematic perspective view illustrating an arrangement of the lighting apparatus of concrete example 6, further provided with a light-transmitting member 696 in a light-irradiating direction. The light-transmitting member 696 is formed to meet the shape or the size of the lighting apparatus 601 through injection molding employing thermosetting type resin or similar as a material. It is also possible to employ a lens-like shape for the purpose of improving light-focusing properties of the lighting apparatus.

By disposing such a light-transmitting member 696, it is possible to achieve a lighting apparatus provided with dust-preventing effects for the reflection surface of the reflection unit 603. It is further possible to obtain a lighting apparatus with desired optical properties.

Respective elements of the embodiment 5 of the invention will now be explained in detail.

(Light Source)

Figure 20:
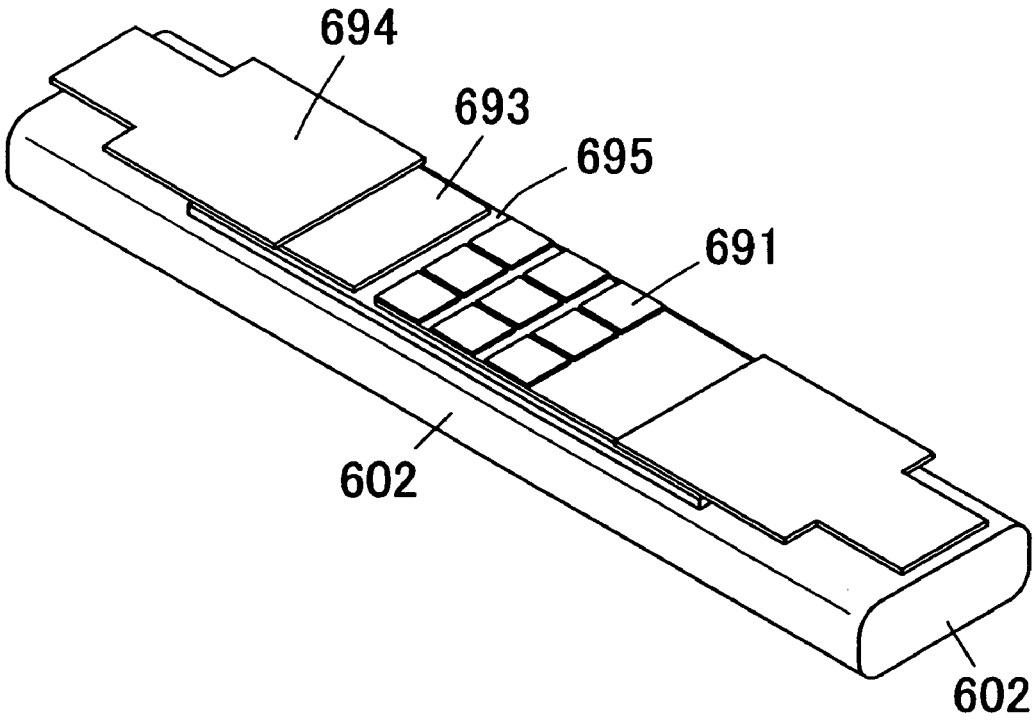
FIG. 20 is a perspective view illustrating one concrete example of a periphery of a light source placing surface of the lighting apparatus according to the embodiment 5 of the invention.
Figure 21:
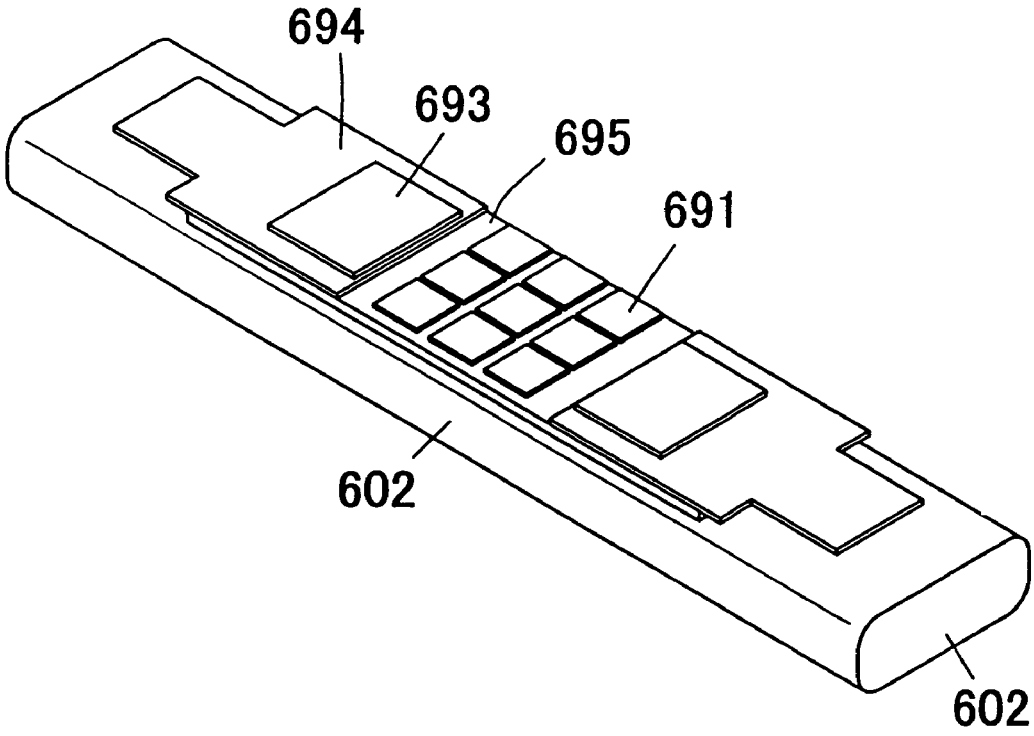
FIG. 21 is a perspective view illustrating another concrete example of a periphery of a light source placing surface of the lighting apparatus according to the embodiment 5 of the invention.

The above-described concrete examples 1 to 6 have been explained on the basis of an example in which light-emitting diodes were employed as the light source. However, the light source of the present embodiment 5 may have various types of light-emitting bodies such as light-emitting diodes, electric bulbs or fluorescent lamps. As illustrated in the above-described concrete examples, the light source of the present embodiment 5 is mounted onto the heat transfer unit either directly or via a heat conductive base. When it is mounted via the heat conductive base, the light-emitting diode 691 is placed onto a heat conductive base 695 to be disposed such that it enables electric connection between the light-emitting diode and the conductive substrate 694 as exemplarily illustrated in FIGS. 20 and 21. It should be noted that while the conductive substrate 694 is formed with a metallic bump 693 for electric connection with the light source, it is alternatively possible to dispose the metallic bump 693 on a lower side of the conductive substrate 694 as illustrated in FIG. 20 or to dispose the same on an upper side of the conductive substrate 694 as illustrated in FIG. 21.

When mounting the light source onto the heat transfer unit or the heat conductive base, it is preferable that an inclined surface that opposes a side surface of the light source for reflecting light that is emanated from a side surface of the light source in the direction of the reflection surface is formed on the heat transfer unit or the heat conductive base. By forming such an inclined surface provided with reflection functions, it is possible to reflect light from the light source by the inclined surface so as to effectively irradiate light in the direction of the reflection surface of the reflection unit.

(Heat Transfer Unit)

In the present embodiment 5, a member that may be used as the heat transfer unit is, for instance, the heat pipe.

In the present embodiment 5, the heat transfer unit may be of various shapes. More particularly, the size of the light source placing surface onto which the light source is placed is defined to be a minimum size with which the light source may be placed thereon such that light reflected from the reflection unit in the front direction of the lighting apparatus is shielded as little as possible while a supporting portion for supporting the light source placing surface is processed to be thinner than the light source placing surface as much as possible. For instance, when the lighting apparatus of the invention is seen from above as illustrated in FIG. 14, the supporting portion 653 is thinner than the light source placing portion 652. As illustrated in FIGS. 9 to 17, it is alternatively possible to employ an arrangement in which the heat transfer unit 632 is bent and end portion 605 of the heat transfer unit 632 is connected to the heat dissipation unit 654 or the terminal 604. Here, the terminal 604 functions to fix the lighting apparatus onto a mounting surface of a heat sink or similar and to dissipate heat that is transferred from the heat transfer unit 632 to the mounting surface side. Further, as illustrated in FIG. 11 or 16, when employing an arrangement in which a through hole is provided on a lowermost bottom portion of the reflection surface of the reflection unit 603 and in which a heat transfer unit 682 is made to project from the lowermost bottom portion that is formed to have a concaved surface shape, it is possible to project the same in a shape of the letter S. By performing such processing, it is possible to increase a contact area between the heat transfer unit and the heat dissipation unit for improving the heat dissipation effects. When employing an arrangement in which a substrate disposed with a conductive pattern is provided on the heat transfer unit, it is possible to achieve a positional relationship in which connection between the conductive pattern and external electrodes may be easily established.

(Heat Dissipation Unit)

A heat sink 654 that may be employed in the present embodiment 5 as a heat dissipation unit is provided with a function of dissipating heat that is discharged from the light source via the heat transfer unit, over a rear surface of the lighting apparatus and to the exterior of the lighting apparatus.

The heat sink 654 may be formed to assume various sizes in view of heat dissipation properties or output of the light source. In other words, the heat sink may be increased in size the higher the output of the light source is. It is preferable that the heat dissipation unit, to which the end portion of the heat transfer unit is connected, exhibits favorable heat conductivity for effectively dissipating heat that has been discharged from the light source to the exterior. A concrete heat conductivity of such a heat dissipation unit is preferably not less than 0.01 cal/(s)(cm$^2$)(° C./cm), and more preferably not less than 0.5 cal/(s) (cm$^2$)(° C./cm).

As for materials of the heat dissipation unit, copper, aluminum or phosphor bronze plate surfaces that underwent metallic plating such as silver and palladium or silver and gold or solder plating is favorably employed. In case such silver-plating is performed, it is preferable since the reflection rate of light emitted from the light source will become higher to thereby improve the light extracting efficiency of the lighting apparatus.

(Heat Conductive Base)

The heat conductive base of the present embodiment 5 is provided between the light source and the heat transfer unit and is provided with a function of enabling easy placement of the light source thereon and of transferring heat generated at the light source to the heat transfer unit. It is accordingly preferable that the heat conductive base exhibits favorable heat conductivity for efficiently transferring heat generated at the light source to the heat transfer unit. While the shape of the heat transfer base is decided in view of heat dissipation properties or output of the light source, it may have, for instance, plate-like metal for the purpose of fixing and supporting the light source in a stable condition and of efficiently transferring heat generated at the light source, wherein the light source is mounted to one main surface thereof while the other main surface is in surface contact with the heat transfer unit.

A concrete heat conductivity of such a heat conductive base is preferably not less than 0.01 cal/(s)(cm$^2$)(° C./cm), and more preferably not less than 0.5 cal/(s)(cm$^2$)(° C./cm).

As for materials of the heat conductive base, copper, aluminum or phosphor bronze plate surfaces that underwent metallic plating such as silver, palladium or gold or solder plating is favorably employed. The reason for performing such silver-plating or similar is to improve the reflection rate of light emitted from the light source to thereby improve the light extracting efficiency of the lighting apparatus.

It is possible to provide a conductive pattern for supplying electric power to the light source on the heat conductive base via an insulating member.

(Reflection Unit 603)

The reflection unit of the present embodiment is provided with a reflection surface that is arranged to oppose the light source for reflecting light that is irradiated from the reflection unit in the front direction of the lighting apparatus. It is accordingly preferable to process the reflection surface of the reflection unit for reflecting irradiated light to assume a concaved surface shape and to perform metallic plating such as silver plating or similar on the surface thereof. By improving such silver plating, it is possible to improve the reflectivity of light.

As explained so far, according to the lighting apparatus of embodiment 5 of the invention, it is possible to provide a lighting apparatus capable of performing high-output irradiation by using a light-emitting diode upon arranging the same as a reflecting type lighting apparatus having a heat transfer unit.

The lighting apparatus of the above embodiment 5 was a reflecting type lighting apparatus. However, the applicable field of the arrangement of mounting a light source such as a light-emitting diode onto the heat transfer unit of the invention either directly or via a heat conductive substrate is not limited to reflecting type lighting apparatuses alone.

For instance, it is possible to directly mount the light-emitting diode onto the base 202 of the lighting apparatus of embodiment 2 that corresponds to the heat conductive base of embodiment 5 to thereby obtain the same effects as those of embodiment 5.

The same effects as those of embodiment 5 may be achieved also by directly mounting the light-emitting diode onto the heat transfer unit 23 in the lighting apparatus of embodiment 2 that is not of a reflecting type.

In such cases, the same actions and effects as those of embodiment 5 may be obtained regardless of the presence of the movable rotating mechanism.

For instance, when the light-emitting diode is directly mounted onto the spherical end portion of the heat transfer unit 3 of embodiment 1, the same actions and effects as those of embodiment 5 may be obtained even though it is not movable in a rotating manner.

As explained so far in detail, the lighting apparatus according to the invention is capable of rapidly transmitting heat that is generated at the light source such as a light-emitting diode or the light-emitting unit to the heat dissipation unit for performing effective heat dissipation, it is possible to suppress increases in temperature of the light source such as the light-emitting diode or the light-emitting unit. It is possible to change the light emanation direction by a simple and small-sized moving mechanism. It is further possible to provide a lighting apparatus of a reflecting type of superior high-output properties that is capable of rapidly dissipating heat generated at the light source or similar.

What is claimed is:

1. A lighting apparatus comprising:

a light-emitting unit;

a heat dissipation unit for dissipating heat generated by the light-emitting unit during light emission; and a heat transfer unit connected between the light-emitting unit and the heat dissipation unit, wherein the light-emitting unit is in surface contact with the heat transfer unit and is rotatable about a single center point or a single center line independently of the heat dissipation unit.

2. The lighting apparatus according to claim 1, wherein:

the heat transfer unit comprises a spherical end portion at one end; and the light-emitting unit comprises a spherical-surface receiving section comprising a spherical surface, and is connected to the heat transfer unit so that a surface of the spherical end portion is in surface contact with a surface of the spherical-surface receiving section.

3. The lighting apparatus according to claim 1, wherein:

a portion of the heat transfer unit is a circular-cylindrical connection portion; and the light-emitting unit comprises a receiving section comprising a circumferential surface, and is connected to the heat transfer unit so that a surface of the connection portion is in surface contact with the circumferential surface of the receiving section.

4. The lighting apparatus according to claim 1, wherein:

a portion of an outer periphery the heat transfer unit is formed in an arcuate shape; and the light-emitting unit comprises an inner-periphery receiving surface with which the outer periphery having the arcuate shape is engaged, and is formed in a state where the outer periphery having the arcuate shape and the inner-periphery receiving surface are engaged with one another.

5. The lighting apparatus according to claim 1, wherein the light-emitting unit comprises at least one light-emitting diode.

6. The lighting apparatus according to claim 1, wherein said heat dissipation unit has a heat dissipation layer including ceramics for irradiating far-infrared rays onto the surface thereof.

7. The light apparatus according to claim 1, wherein said heat-transfer unit is a heat pipe.

8. A lighting apparatus comprising:

a light-emitting unit and a heat dissipation unit for dissipating heat generated by the light-emitting unit during light emission; and a heat transfer unit connected between the light-emitting unit and the heat dissipation unit, wherein the heat dissipation unit is in surface contact with the heat transfer unit, and the light-emitting unit is rotatable about a single center point or a single center line independently of the heat dissipation unit.

9. The lighting apparatus according to claim 8, wherein:

the heat transfer unit comprises a spherical end portion at one end; and the heat dissipation unit comprises a spherical-surface receiving section comprising a spherical surface, and is connected to the heat transfer unit so that a surface of the spherical end portion is in surface contact with a surface of the spherical-surface receiving section.

10. The lighting apparatus according to claim 8, wherein:

a portion of the heat transfer unit is a circular-cylindrical connection portion; and the heat dissipation unit comprises a receiving section comprising a circumferential surface, and is connected to the heat transfer unit so that a surface of the connection portion is in surface contact with the circumferential surface of the receiving section.

11. The lighting apparatus according to claim 8, wherein:

a portion of an outer periphery the heat transfer unit is formed in an arcuate shape; and the heat dissipation unit comprises an inner-periphery receiving surface with which the outer periphery having the arcuate shape is engaged, and is formed in a state where the outer periphery having the arcuate shape and in the inner-periphery receiving surface are engaged with one another.

12. The lighting apparatus according to claim 8, wherein the light-emitting unit comprises at least one light-emitting diode.

13. The lighting apparatus according to claim 8, wherein said heat dissipation unit has a heat dissipation layer including ceramics for irradiating far-infrared rays onto the surface thereof.

14. The lighting apparatus according to claim 8, wherein said heat-transfer unit is a heat pipe.

15. The lighting apparatus according to claim 2, wherein a grease is applied on the spherical surface of the spherical-surface receiving section.

16. The lighting apparatus according to claim 9, wherein a grease is applied on the spherical surface of the spherical-surface receiving section.

17. The lighting apparatus according to claim 1, wherein the light-emitting unit is fixed to a movable luminous distribution cover and the light-emitting unit moves together with the movable luminous distribution cover.

18. The lighting apparatus according to claim 1, wherein the heat transfer unit is fixed to the heat dissipation unit using a metal fastening device.

19. The lighting apparatus according to claim 1, wherein the heat dissipation unit is in surface contact with the heat transfer unit so that the light-emitting unit is rotatable.

* * * * *